US009145692B2

(12) United States Patent
Saravanos

(10) Patent No.: US 9,145,692 B2
(45) Date of Patent: Sep. 29, 2015

(54) TILE CUTTING TOOL AND METHODS

(71) Applicant: Peter G. Saravanos, Framingham, MA (US)

(72) Inventor: Peter G. Saravanos, Framingham, MA (US)

( * ) Notice: Subject to any disclaimer, the term of this patent is extended or adjusted under 35 U.S.C. 154(b) by 85 days.

(21) Appl. No.: 13/767,690

(22) Filed: Feb. 14, 2013

(65) Prior Publication Data

US 2013/0212892 A1 Aug. 22, 2013

Related U.S. Application Data

(60) Provisional application No. 61/600,378, filed on Feb. 17, 2012.

(51) Int. Cl.
*E04F 21/00* (2006.01)

(52) U.S. Cl.
CPC ..... *E04F 21/0076* (2013.01)

(58) Field of Classification Search
CPC ..... B28D 1/225; B28D 1/226; B28D 7/00; B28D 1/041; B25H 7/02; E04F 21/0076; E04F 21/00; E04F 21/20
USPC ..... 33/526, 527
See application file for complete search history.

(56) References Cited

U.S. PATENT DOCUMENTS

| | | | | |
|---|---|---|---|---|
| 241,241 | A | 5/1881 | Ruge | |
| 1,041,145 | A | 10/1912 | Moss | |
| 2,179,415 | A | 11/1939 | Mace | |
| D136,978 | S | 1/1944 | Tomasini | |
| 2,759,271 | A | 8/1956 | Von Duyke | |
| 2,840,914 | A | 7/1958 | Buckelew | |
| 2,949,674 | A | 8/1960 | Wexler | |
| 3,269,015 | A | 8/1966 | Barker | |
| 3,419,965 | A | 1/1969 | Madden | |
| 3,483,629 | A | 12/1969 | English | |
| 4,622,751 | A | 11/1986 | Berg | |
| 4,827,625 | A | 5/1989 | Le Moal | |
| 5,007,178 | A | 4/1991 | Dewire et al. | |
| 5,014,441 | A | 5/1991 | Pratt | |
| 5,546,668 | A | 8/1996 | Ahdoot | |
| 6,022,132 | A | 2/2000 | Schulz | |
| 6,101,730 | A * | 8/2000 | Marino | 33/526 |
| 6,112,424 | A | 9/2000 | Friend | |
| 6,195,904 | B1 | 3/2001 | Greer | |
| 6,481,112 | B1 | 11/2002 | White | |
| 7,020,973 | B2 * | 4/2006 | Knight, Jr. | 33/526 |
| 7,980,921 | B2 * | 7/2011 | Saravanos | 33/527 |

(Continued)

FOREIGN PATENT DOCUMENTS

| | | |
|---|---|---|
| DE | 203 04 786 | 7/2003 |
| EP | 1 207 029 A1 | 5/2002 |

(Continued)

*Primary Examiner* — Yaritza Guadalupe-McCall

(57) ABSTRACT

A tool and method for marking dimensions for cutting a tile include a platform with a front wall defining an x axis, a side wall defining a y axis, with the y axis being perpendicular to the x axis, and a front guideline defining an x' axis parallel to the x axis. Also included are a plurality of extendable fingers which are manually extendable to releasably retained protracted positions. A conformable member is disposed at the distal end of each finger, and is configured to conformably match the contour of an obstruction. The platform is configured for superposed alignment with an installed tile adjacent to an area with the obstruction, and also for alignment with a loose tile to be cut. The conformable members provide a guide for marking the surface of the loose tile to accommodate the obstruction.

20 Claims, 35 Drawing Sheets

(56) References Cited

U.S. PATENT DOCUMENTS

| | | | | |
|---|---|---|---|---|
| 2006/0037207 | A1 | 2/2006 | Knight, Jr. | |
| 2006/0062998 | A1 | 3/2006 | Taylor et al. | |
| 2013/0212892 | A1 * | 8/2013 | Saravanos | 33/527 |

FOREIGN PATENT DOCUMENTS

| | | |
|---|---|---|
| EP | 1 338 387 | 8/2003 |
| FR | 2 836 647 | 9/2003 |
| GB | GR 2 379 709 | 3/2003 |

* cited by examiner

Fig. 22
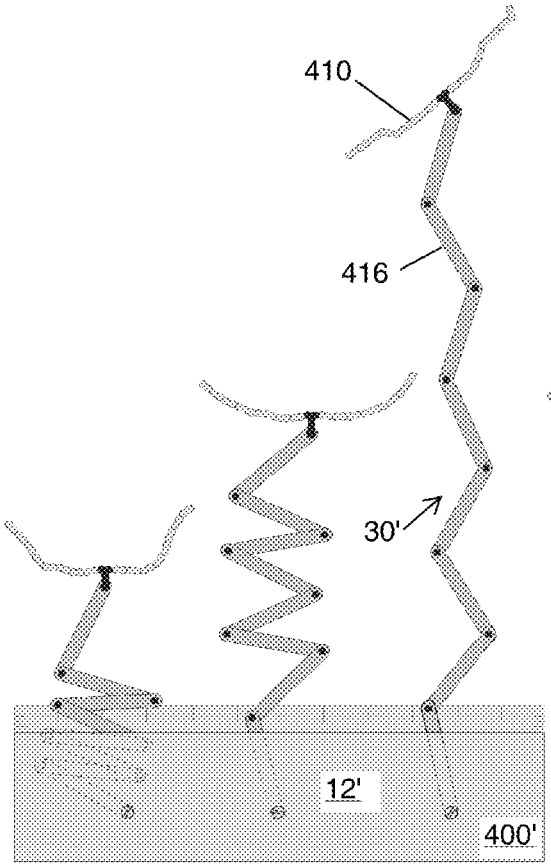
Fig. 21B
Fig. 21A
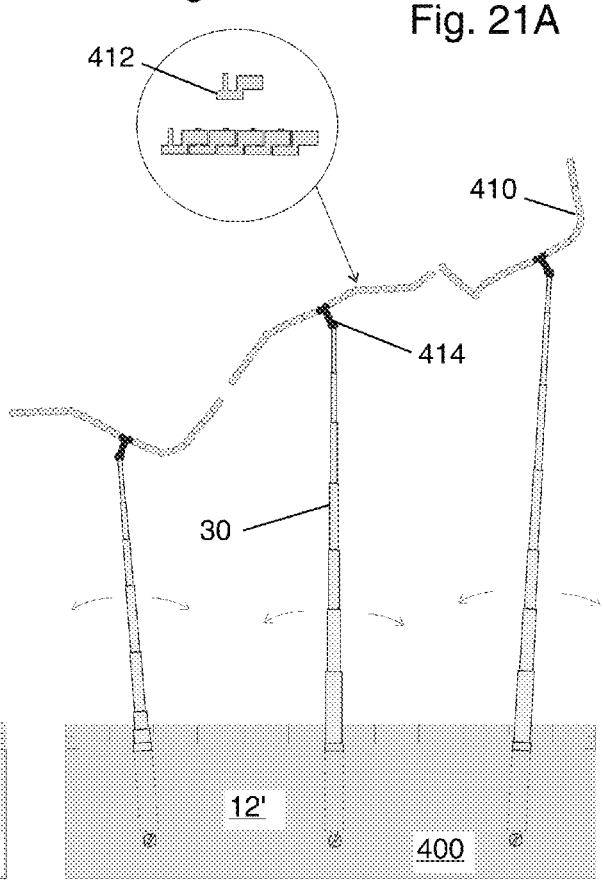

TILE CUTTING TOOL AND METHODS

RELATED APPLICATIONS

This application is related to U.S. Pat. No. 7,980,921, entitled Tile Cutting Tool and Methods, issued on Jul. 19, 2011, and claims priority to U.S. Provisional Patent Application Ser. No. 61/600,378 entitled Tile Cutting Tool and Methods, filed on Feb. 17, 2012, both of which are fully incorporated herein for all purposes.

BACKGROUND

1. Technical Field

This invention relates to measuring instruments, and more particularly to instruments for determining dimensions for cutting tiles.

2. Background Information

Throughout this application, various publications, patents and published patent applications are referred to by an identifying citation. The disclosures of the publications, patents and published patent applications referenced in this application are hereby incorporated by reference into the present disclosure.

When installing floor tiles, it is sometimes necessary to install a tile in an irregularly shaped area with an obstruction. A tile installer will typically mark out dimensions for cutting a tile to fit in the area. To determine the cutting dimensions, the installer may use a tape measure to make multiple length measurements of the area. A drawback to using measuring instruments such as tape measures, is that only one dimension is measured, such as length, without the context of a second dimension, such as the location of the length dimension in reference to the width of the area. Accurate measurements may therefore be difficult to make. As a result, tile installers typically cut an initial template tile for filling the area, and repeatedly refine the template until it fits in the area. This is approach is time consuming and inefficient for professionals, and beyond the skill level of many amateur tile installers such as home owners.

Woodworking gauges, such as those used by carpenters for tracing contours of objects such as walls and moldings, may not be suitable for use in tile installation. The woodworking gauges tend to be relatively small, typically less than twelve inches, with rigid rods held in friction fit. The woodworking gauge is not designed to be anchored on a floor for making dimensional measurements of an area adjacent to the object. Instead, the woodworking gauges designed to be pushed towards an object, so that the rods are forced into the contour of the object.

Therefore, a need exists for a two dimensional measuring instrument for measuring dimensions for cutting a tile.

SUMMARY

In one aspect of the invention, a tool for determining dimensions for cutting a tile includes a body with a platform. The platform has a planar top face, a front wall defining an x axis, and a side wall defining a y axis, with the y axis being perpendicular to the x axis. The platform includes a front guideline disposed on the top face which defines an x' axis, which is parallel to the x axis.

In this aspect of the invention, the body includes a plurality of individually extendable telescopic fingers with distal ends. Each finger is manually extendable, in parallel with the y axis, to a protracted position. The protracted position may be releasably retained until the finger is manually collapsed back to a contracted position.

In this aspect, the platform is configured for secured placement on an installed tile with a side edge and an open edge adjacent to an area with an obstruction, wherein the front guideline is positioned in superposed alignment with the open edge, and the side wall is positioned in superposed alignment with the side edge. A selection of two or more fingers of the plurality of fingers may be extended to protracted positions in which the distal end of each selected finger is engaged with the obstruction.

In this aspect of the invention, the platform is also configured for removal from the installed tile and for placement adjacent to a loose tile to be cut, wherein the front wall is placed along a first edge of the loose tile, the platform side wall is positioned in alignment with a second edge of the loose tile, and the fingers of the selection are projected over the loose tile, and wherein the distal ends of the fingers of the selection define dimensions for cutting the loose tile.

In another aspect of the invention, the body includes a computing element with a processor and a memory storage component. The computing element is configured to store and retrieve data relating to configurations of x and y coordinates of the fingers. This aspect also includes a user interface configured for user control of the computing element.

In another aspect of this invention, a method for determining dimensions for cutting a tile includes securely positioning an embodiment of the tool on an installed tile, wherein the front wall is placed on superposed alignment with an open edge of the installed tile, and the side wall is placed in superposed alignment with a side edge of the installed tile. This aspect also includes extending two or more fingers from the plurality of fingers to protracted positions, wherein the distal end of each protracted finger engages the obstruction.

This aspect further includes removing the tool from the installed tile; and placing the tool adjacent to a loose tile, wherein the front wall is placed along a first edge of the loose tile, and the side wall is positioned in alignment with a second edge of the loose tile.

In yet another aspect of this invention, a method of manufacturing a tool for determining dimensions for cutting a tile includes forming a body with a platform, the platform having a planar top face, a front wall defining an x axis, and a side wall defining a y axis, with the y axis being perpendicular to the x axis. This aspect also includes disposing a front guideline on the top face, the front guideline extending along an x' axis, the x' axis being parallel to the x axis.

This aspect further includes disposing on the body a plurality of individually extendable telescopic fingers; and configuring each finger of the plurality to be manually extendable, in parallel with the y axis, to a protracted position, the protracted position being releasably retained until the finger is manually collapsed to a contracted position.

This method further includes configuring the platform for secured placement on an installed tile with a side edge and an open edge adjacent to an area with an obstruction, wherein the front guideline is positioned in superposed alignment with the open edge, and the side wall is positioned in superposed alignment with the side edge. This method also includes further configuring the platform for removal from the installed tile; and further configuring the platform for placement adjacent to a loose tile to be cut, wherein the front wall is placed along a first edge of the loose tile, the platform side wall is positioned in alignment with a second edge of the loose tile, and fingers in protracted position are projected over the loose tile, wherein the distal ends of the protracted fingers define dimensions for cutting the loose tile.

BRIEF DESCRIPTION OF THE DRAWINGS

The above and other features and advantages of this invention will be more readily apparent from a reading of the following detailed description of various aspects of the invention taken in conjunction with the accompanying drawings, in which:

FIG. 21A is plan view of an alternate embodiment of the invention;

FIG. 21B is a plan view, on an enlarged scale, of a portion of FIG. 21A;

FIG. 22 is plan view of another alternate embodiment of the invention;

DETAILED DESCRIPTION

Figure 1A:
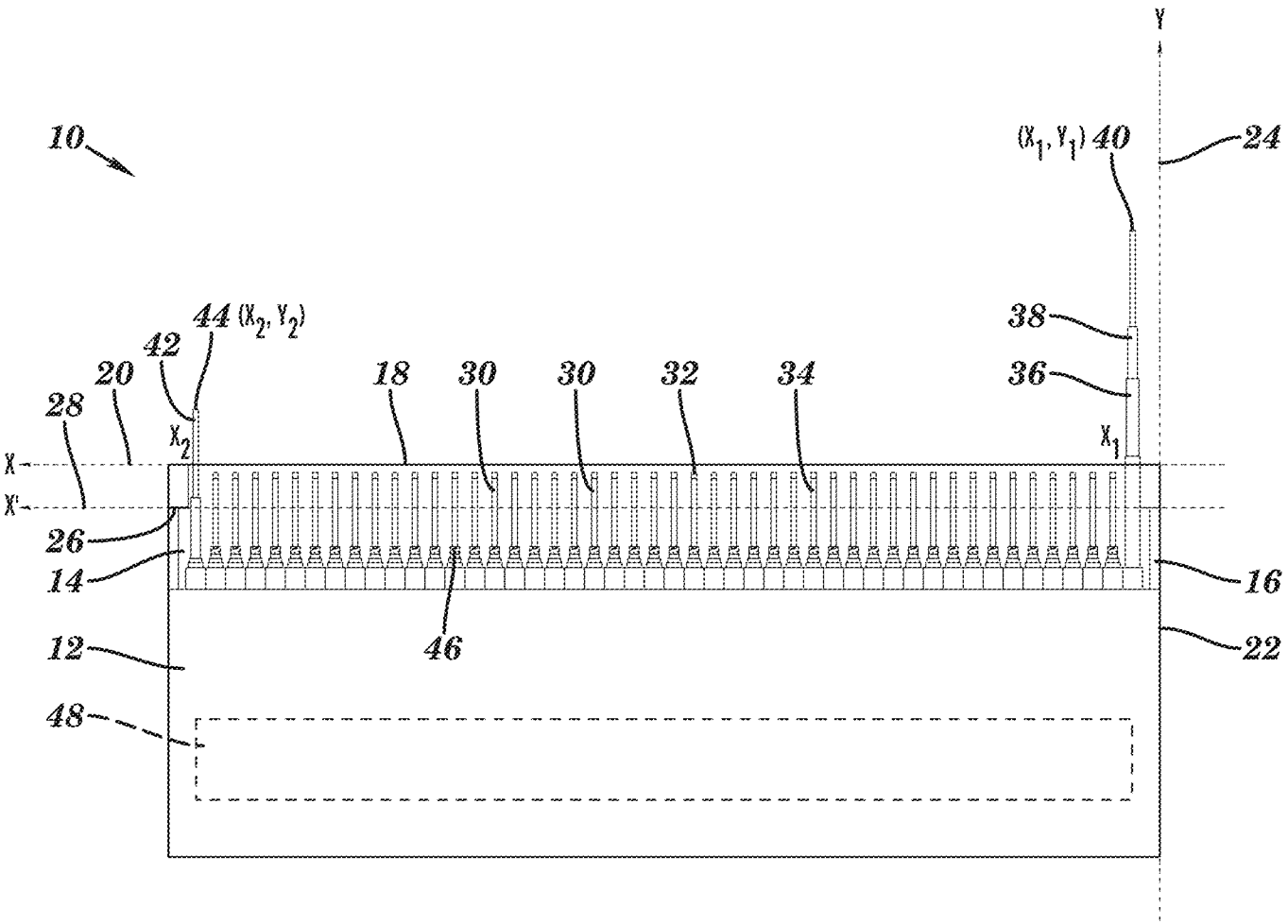
FIG. 1A is a plan view of an embodiment of the invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings shall be indicated with like reference numerals and similar features as shown in alternate embodiments in the drawings shall be indicated with similar reference numerals.

Embodiments of the present invention provide a relatively compact tool that may be used to quickly and easily generate a profile along which a tile may be cut to precisely fit within a space which is at least partially obstructed by a post, wall, or other architectural element. These embodiments may be used by simply placing the tool on a pre-installed tile located adjacent the partially obstructed space, and then extending the fingers until they engage the obstruction. The tool may then be placed alongside a loose tile to be cut, with the fingers extending across the surface of the tile. The tile may then simply be marked at the tips of the extended fingers to define the profile along which the tile is to be cut.

Embodiments of the present invention include a computing element configured for digital storage of measurements in a memory component. In some embodiments, the measurements may be retrieved and displayed on a display disposed on the body. The memory component of some embodiments may be coupled to a cutting tool.

Embodiments of the present invention provide an intuitive method for measuring and marking a loose tile to be cut. By allowing the user to align the tool with the tile to be cut, rather than requiring a user to keep track of mathematical calculations, the user is able to save time and effort. These embodiments therefore make tile installation more accessible for amateur tile installers, such as homeowners.

Embodiments of the present invention further provide a relatively inexpensive method of manufacturing a tool for determining dimensions for cutting a tile.

In the embodiment of FIG. 1A, tool 10 includes a body 12 with a platform 14. The platform side wall 22 defines a Y Axis 24, and the platform 14 front wall 18 defines an X Axis 20. Disposed on the top face 16 of platform 14 is a front guideline 28 which defines an X' Axis, which is parallel to the X Axis.

Tool 10 includes a plurality of telescopic fingers 30 with distal ends 32. Each finger 30 is located at an x coordinate corresponding to a location along the X Axis 20, with the distal ends 32 positioned at a y coordinate corresponding to a location along the Y Axis 24.

Each of the fingers 30 is manually extendable to a protracted position 36, in which the distal end 32 is repositioned at a new y coordinate. The protracted position 36 is retained until the finger 32 is manually collapsed back to a contracted position 34. An optional digitally engagable knob 46 disposed in the proximity of distal end 32 may be used to pull a finger 30 to a protracted position 36 and to push finger 30 back to a contracted position 34. In contrast, the rigid rods of the aforementioned woodworking gauges are not designed to be individually extended to protracted positions. The rods may be prone to breakage if used in this manner.

In the embodiment of FIG. 1A, finger 38 at x coordinate x1 is shown in a protracted position 36 at y coordinate y1, at point (x1, y1) 40. Finger 42 is shown in protracted position 36 at point (x2, y2) 44. Advantageously, only two fingers need to be extended in order to measure an obstruction which forms a straight line across the open area, as discussed below in reference to FIGS. 2 and 3. In contrast, all of the rods of the aforementioned woodworking gauges are typically pushed into the contour of an object.

Figure 1B:
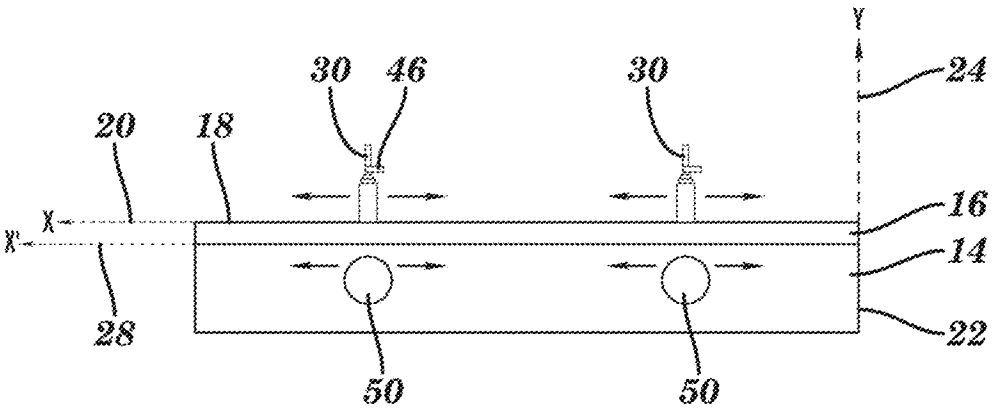
FIG. 1B is a plan view of alternate embodiment of the invention.

The embodiment of FIG. 1B, which contains two fingers 30, may be used with such straight line obstructions. In the embodiment of FIG. 1B, the fingers 30 may be slidably moved in parallel with the X Axis 20 to adjusted X coordinate positions. The adjusted X coordinate positions are releasably retained, for example in a friction fit. Slider knobs 50 are configured for manual sliding of the fingers to adjusted X positions.

Figure 2:
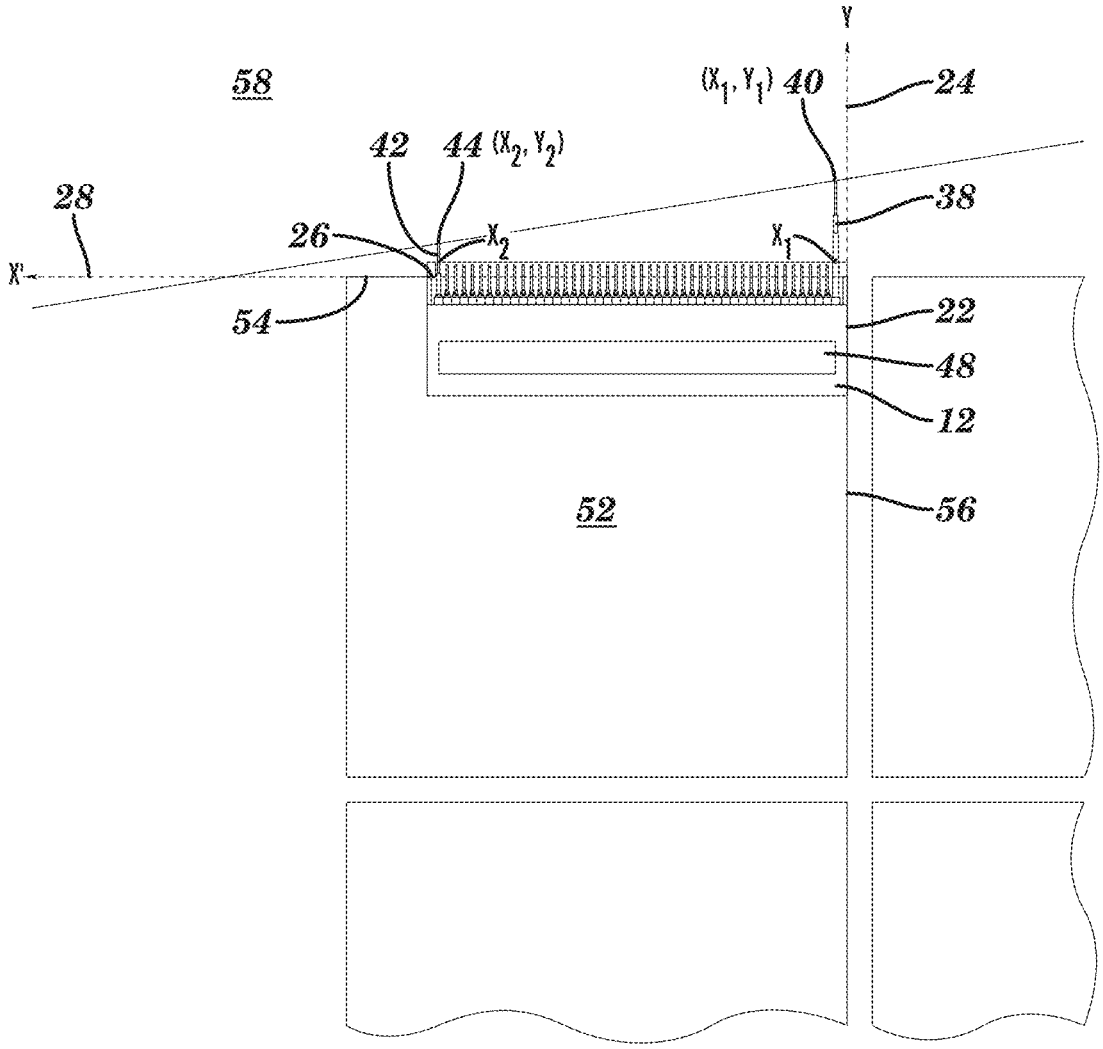
FIG. 2 is a plan view of the embodiment of FIG. 1A in an operative position.

Tool 10 of FIG. 1A is configured to be securely placed on an installed tile next to an open area with an obstruction, as shown in the embodiment of FIG. 2. In contrast, the aforementioned woodworking gauges are not configured to be secured on a surface, but instead are configured to be moved toward an object. Front guideline 28 of tool 10 is configured to be positioned in superposed alignment with open edge 54 of installed tile 52, the open edge 54 being adjacent to the area with the obstruction 58. Side wall 22 is configured to be positioned in superposed alignment with side edge 56 of installed tile 52. As a result, open edge 54 is aligned along the X' Axis 28, and the side edge 56 is aligned along the Y Axis 24.

As shown in the embodiment of FIG. 2, fingers 38 and 44 are in protracted positions 36, with distal ends 32 of fingers 38, 44, in engagement with the obstruction 58. Finger 38 at x1 is extended to point (x1, y1) 40, and finger 42 at x2 is extended to point (x2, y2) 44.

Figure 3A:
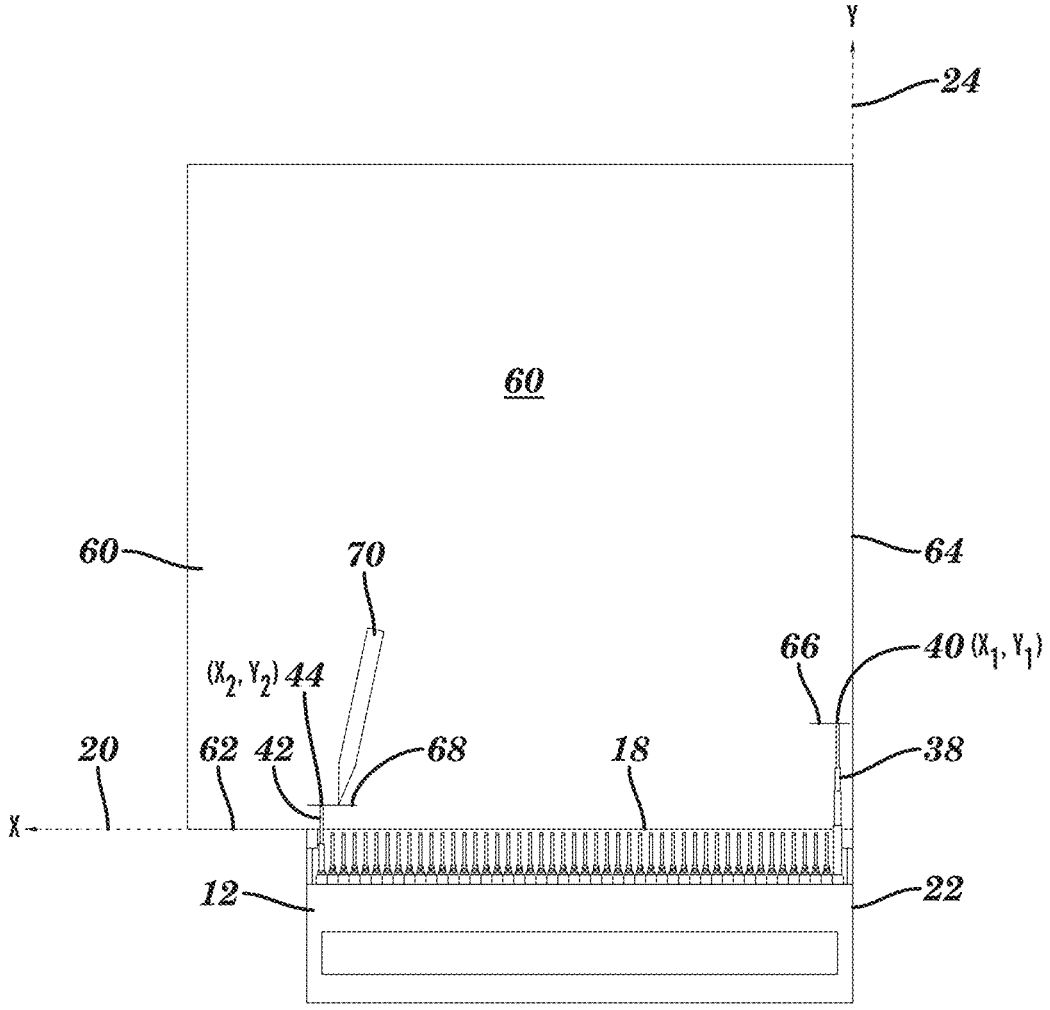
FIG. 3A is a plan view of the embodiment of FIG. 1A in an operative position.
Figure 3B:
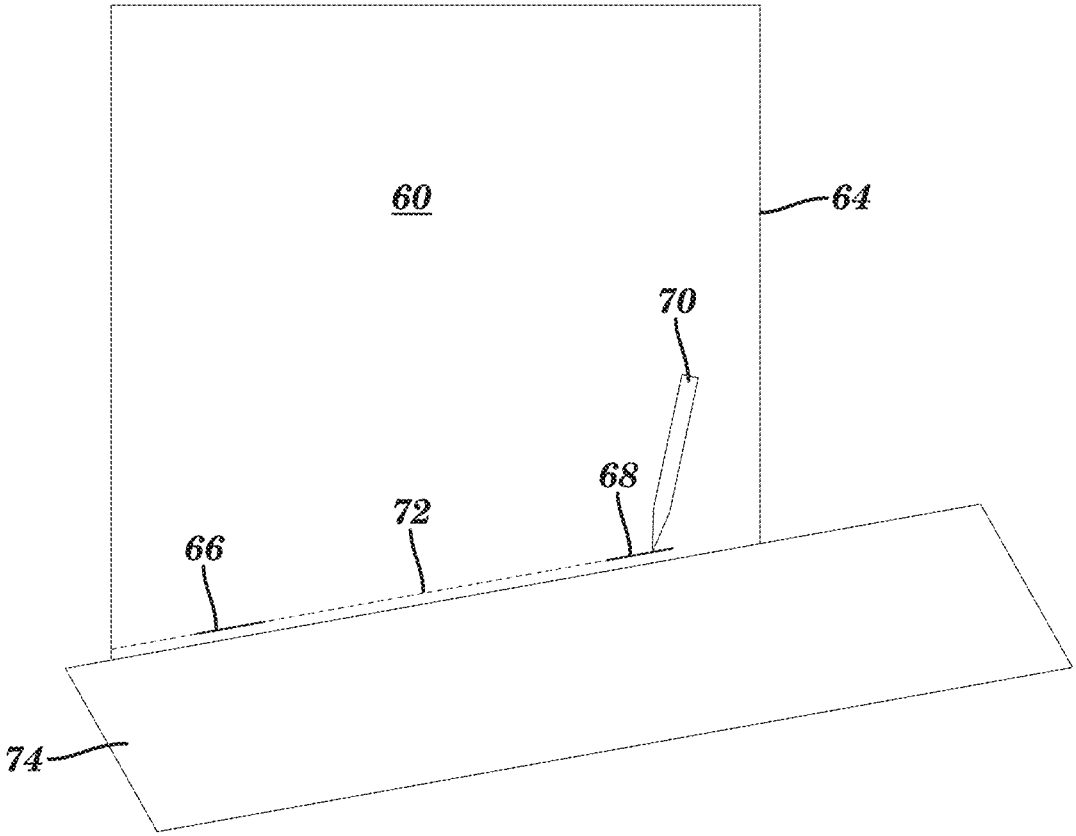
FIG. 3B is plan view of the embodiment of FIG. 1A in an operative position.

The embodiment of FIGS. 3A-3B is configured to be placed adjacent to a loose tile to be cut, with fingers in protracted position projected over the loose tile, as shown in FIG. 3A. Front wall 18 is configured to be placed along first edge 62 of loose tile 60, and side wall 22 is configured to positioned in alignment with second edge 64 of tile 60. First edge 62 is thereby aligned along the X Axis 20, and second edge 64 is aligned along Y Axis 24. As a result, the surface of tile 60 corresponds to the plane defined by the X Axis 20 and Y Axis 24, and points on the surface of tile 60 correspond to points defined by x and y coordinates.

In the embodiment of FIG. 3A, finger 38 is projected over the top surface of tile 60, with its distal end positioned at point 40, at which a first guidemark 66 may be marked with a marking implement 70. Finger 42 is projected over the surface of tile 60, with its distal end positioned at point 44, at which a second guidemark 68 may also be marked with marking implement 70.

As shown in the embodiment of FIG. 3B, guidemarks 66, 68, define a notional profile line 72 for cutting the tile 60. In this example, profile line 72 is a straight line connecting guidemarks 66, 68, which may be drawn with a straight edge 74 and marking instrument 70. In other examples, profile line 72 may form substantially any profile, and may include straight lines, curved lines, and combinations thereof, as discussed in more detail below.

Figure 4A:
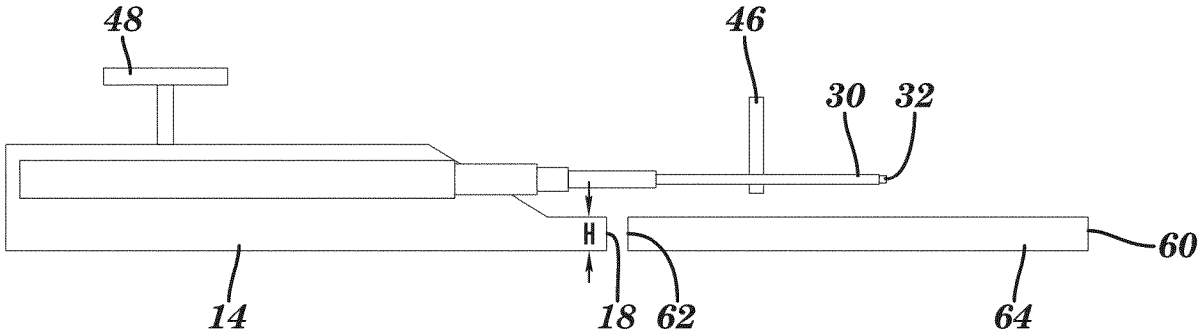
FIG. 4A is an elevational view of the embodiment of FIG. 1A.
Figure 4B:
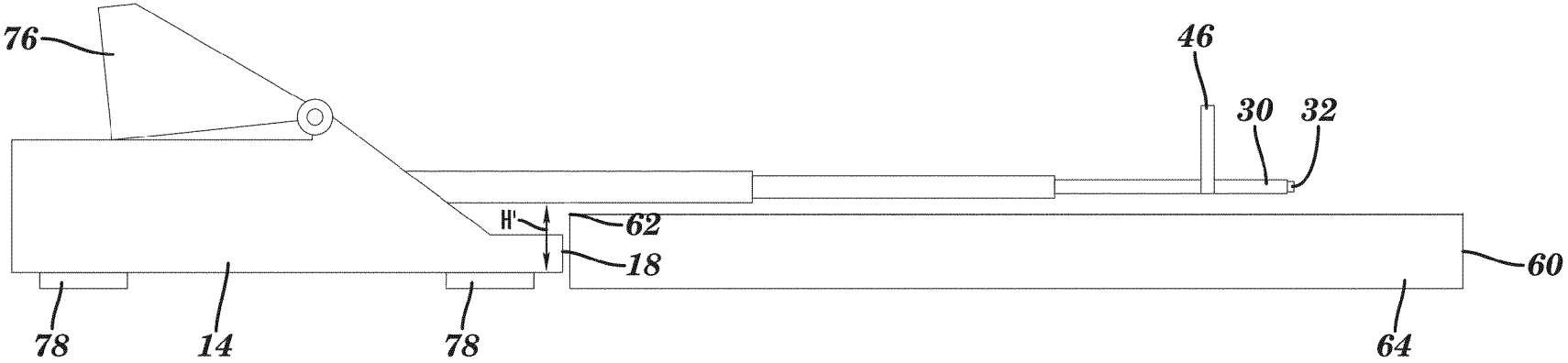
FIG. 4B is an elevational view of an alternate embodiment.

As shown in the embodiment of FIG. 4A, platform 14 should have sufficient height H to allow fingers 30 to project over the surface of adjacent loose tile 60. This is an improvement over the aforementioned woodworking gauges, which are not designed for projecting rods over adjacent items such as tiles. As shown in the alternate embodiment of FIG. 4B, finger 30 is projected over the platform 14 at a sufficient height H' for the finger to clear the surface of loose tile 60. The embodiment of FIG. 4B includes a housing with a hinged cover 76, which may be closed over finger 32 in retracted position 34. The embodiment of FIG. 4B also includes anchoring pads 78, which are configured to releasably secure platform 14 to a surface, such as a surface of an installed tile. For example, anchoring pads 78 may be rubber pads.

Figure 5A:
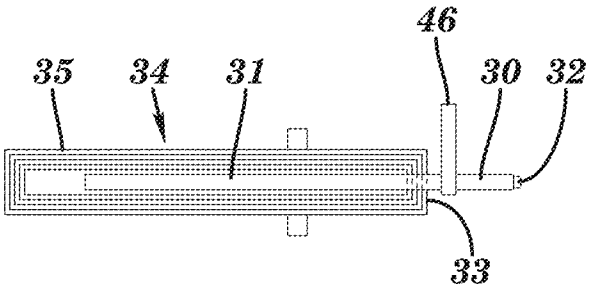
FIG. 5A is an elevational view of a portion of the embodiment of FIG. 1A.
Figure 5B:
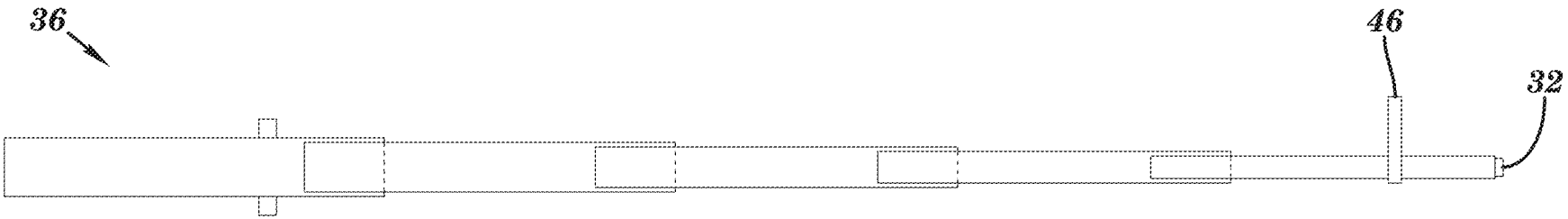
FIG. 5B is an elevational view of a portion of the embodiment of FIG. 1A.

As shown in the embodiment of FIGS. 5A-5B, telescoping finger 30 may be constructed of a series of slidable concentric hollow tubes 31 with necks 33, disposed within outer casing 35. In contracted position 34 (FIG. 1A), the hollow tubes 31 are slidably collapsed, with tubes 31 concentrically disposed within the outer casing 35, as shown in FIG. 5B. In protracted position 36, the tubes 31 are slidably extended from casing 35, as shown in FIG. 5B. The protracted position 36 may be retained in a friction fit, in which necks 33 provide a clamping action on internal tubes 31. The friction fit may be loose enough to be released by collapsing (e.g., pushing) the finger 32 back to contracted position 34. Optional knob 46 disposed in the proximity of the distal end 32 of the most interior tube 31 is configured for manually pulling the finger 30 to protracted position 36, and for manually pushing finger 30 to contracted position 34.

Figure 5C:
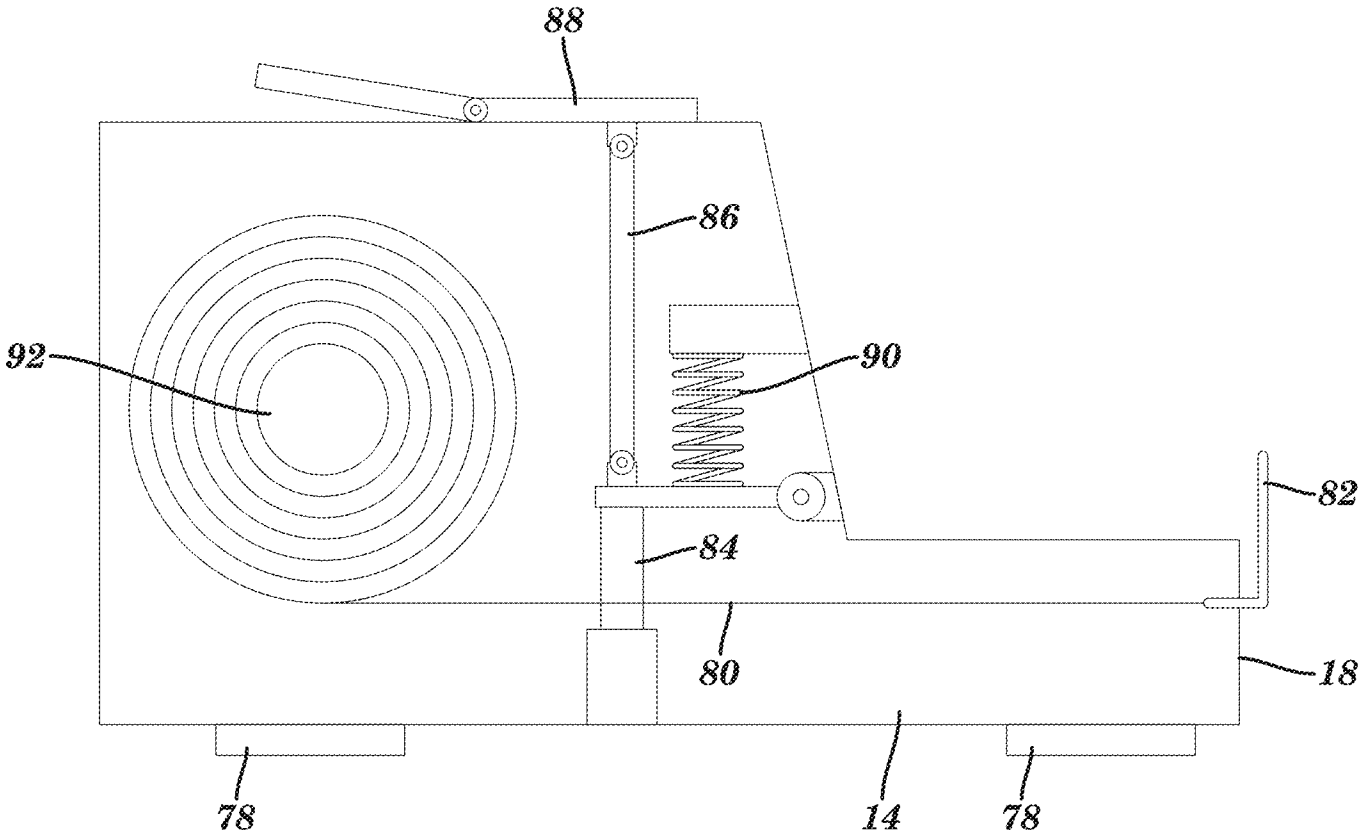
FIG. 5C is an elevational schematic view with portions broken away, of an alternate embodiment.

As shown in the alternative embodiment of FIG. 5C, an extendable measuring strip 80 may be disposed about reel 92. For example, the measuring strip 80 may be a tape measure. The measuring strip 80 may be manually extended with tab 82 to a protracted position, and fixed in the protracted position with stop 84, held by spring loaded lever 86, 90. Stop 84 may be manually controlled with switch 88.

Figure 6A:
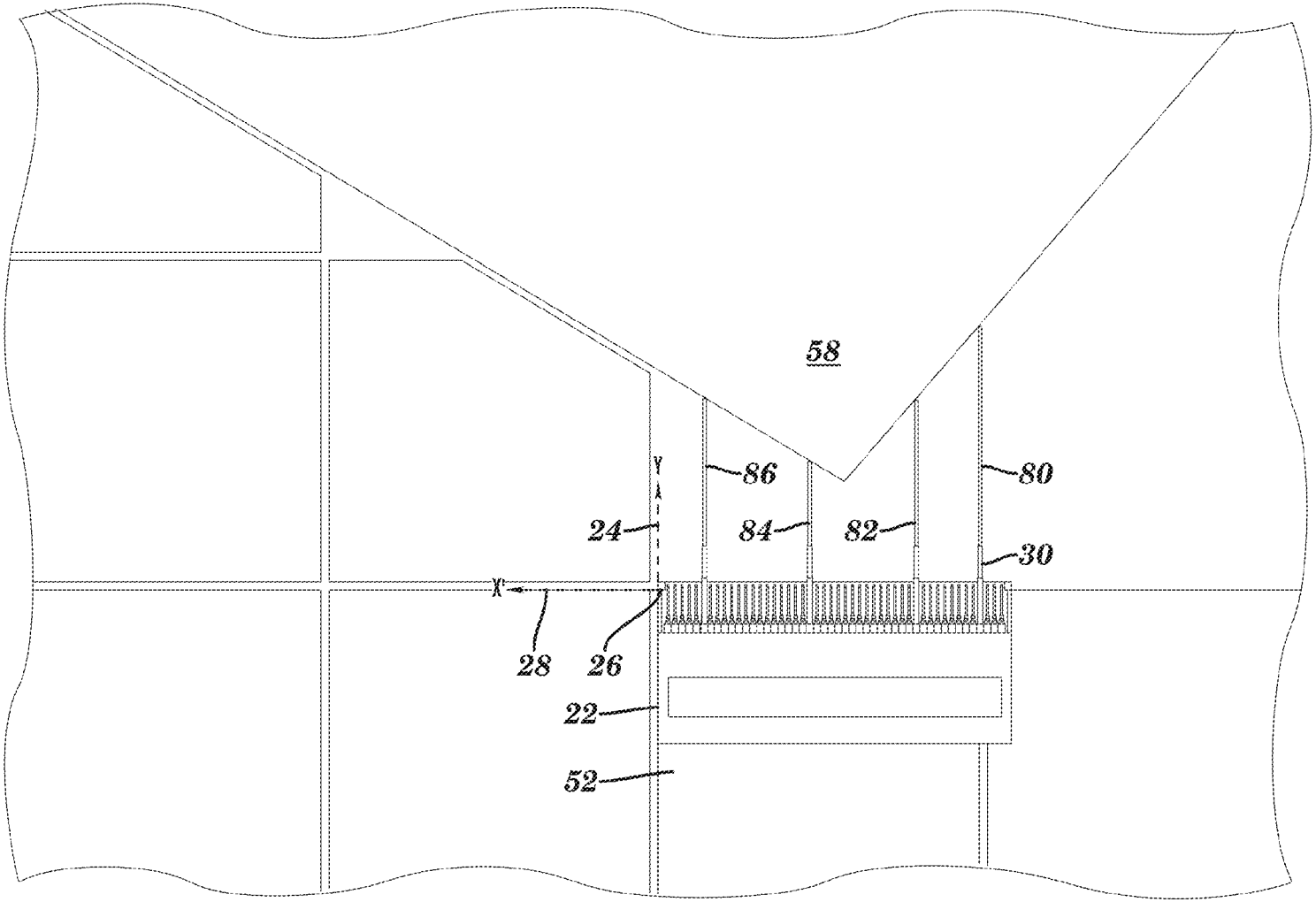
FIG. 6A is a plan view of the embodiment of FIG. 1A in an alternate operative position.
Figure 6B:
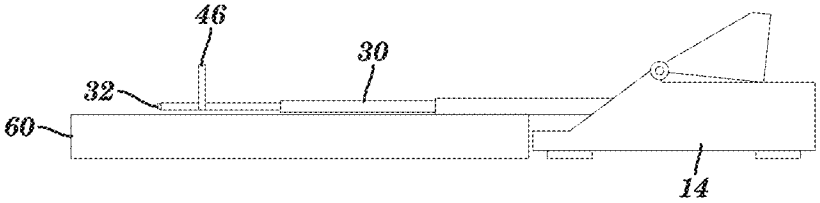
FIG. 6B is an elevational view of the embodiment of FIG. 6A.
Figure 6C:
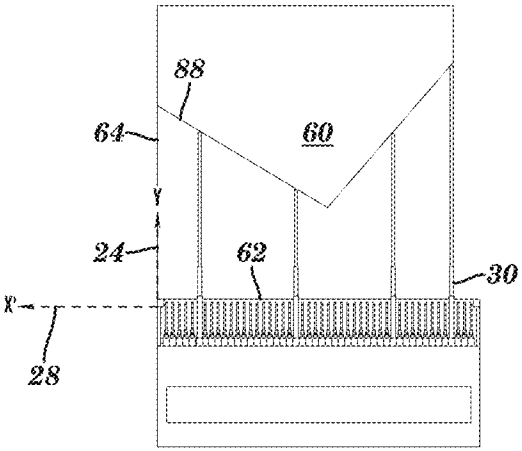
FIG. 6C is a plan view of the embodiment of FIG. 1A in an alternate operative position.

The embodiment of FIGS. 6A-6C is shown in use with more than one finger in protracted position. In this embodiment, side wall 22 defines Y Axis 24, and front guideline 26 defines X' Axis 28. Fingers 80, 82, 84, and 86 are shown in protracted positions in engagement with obstruction 58 in FIG. 6A. As shown in FIGS. 6B-6C, the fingers 80, 82, 84, and 86 are projected over the surface of adjacent loose tile 58, defining cutting line 88.

Figure 7A:
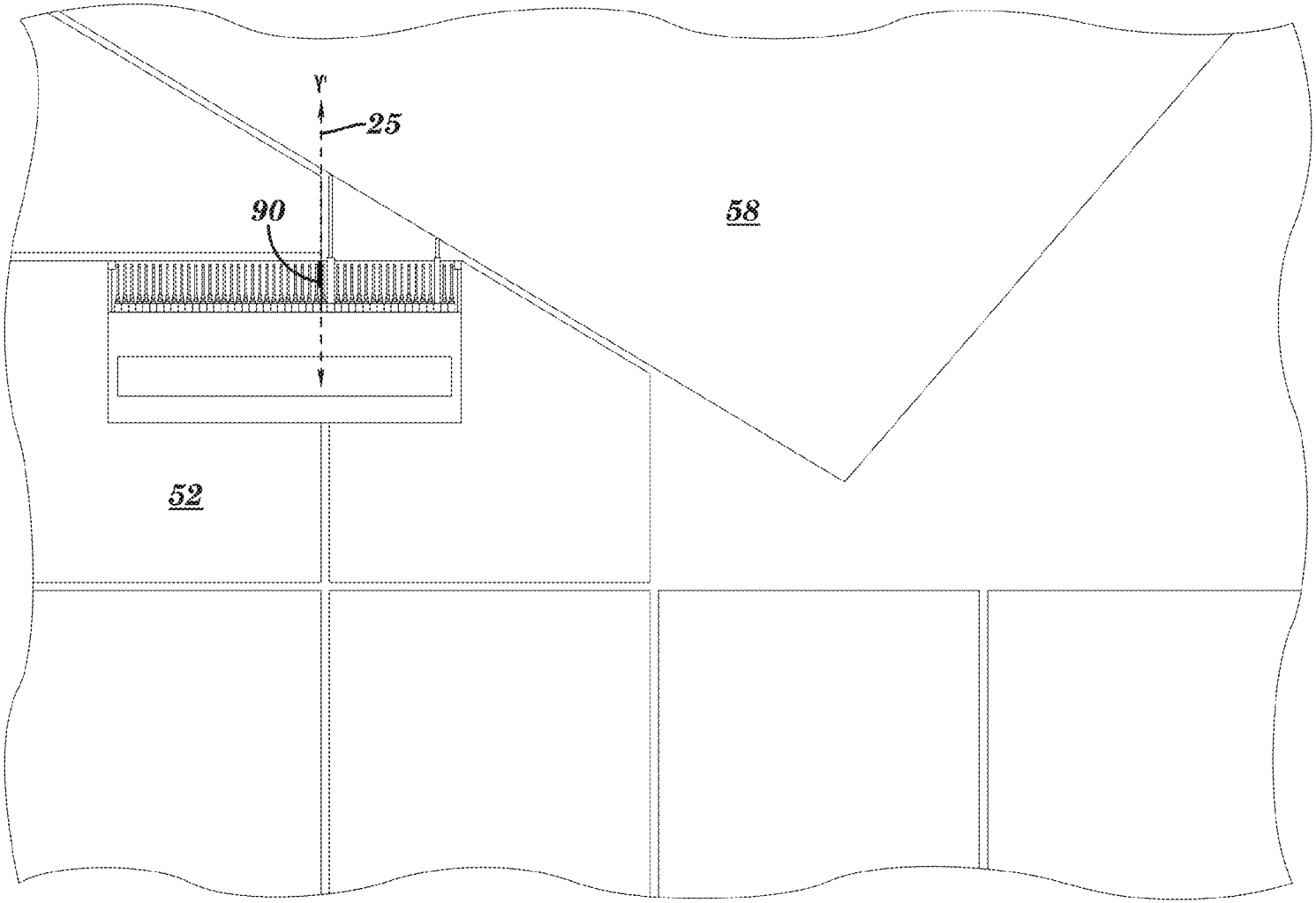
FIG. 7A is a plan view of an alternate embodiment in an operative position.
Figure 7B:
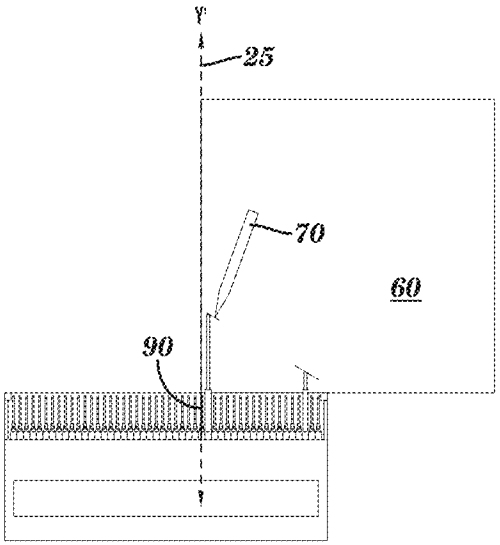
FIG. 7B is an elevational view of the embodiment of FIG. 7A.

In some applications, an area with an obstruction may not provide sufficient clearance to define a Y axis 24 with side wall 22. For example, as shown in the embodiment of FIGS. 7A-7B, an alternate Y' Axis 25 may be defined by a selected side guideline from plurality of side guidelines 90 disposed on the top face of the platform 14. The side guidelines 90 extend in parallel to the Y Axis 24, so that the alternate Y' Axes 25 are parallel to the Y Axis 24. As shown in FIG. 7B, the selected guideline 90 may be positioned in alignment with a second edge 64 of a loose tile 60, so that the second edge 64 is aligned along the Y' Axis 25.

Figure 8:
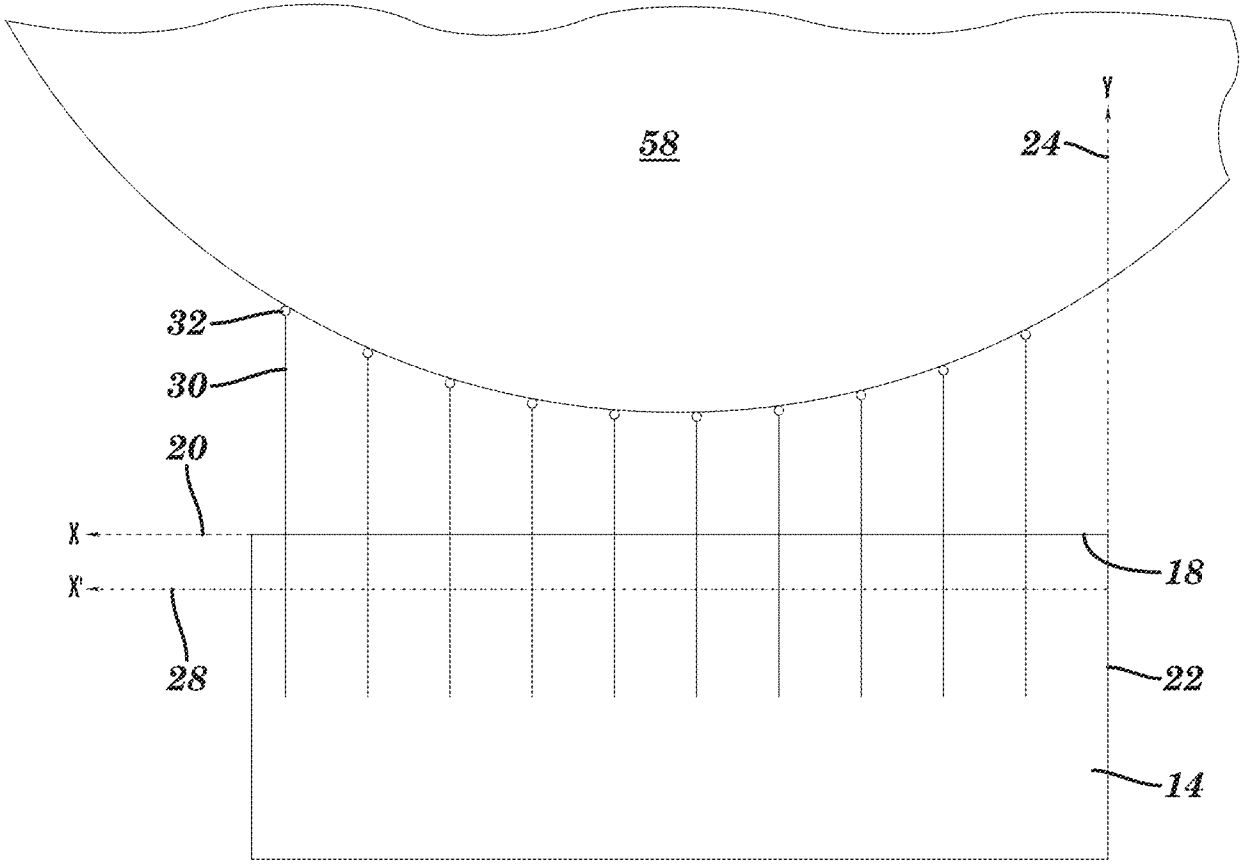
FIG. 8 is a schematic plan view of an alternate embodiment in an operative position.
Figure 9:
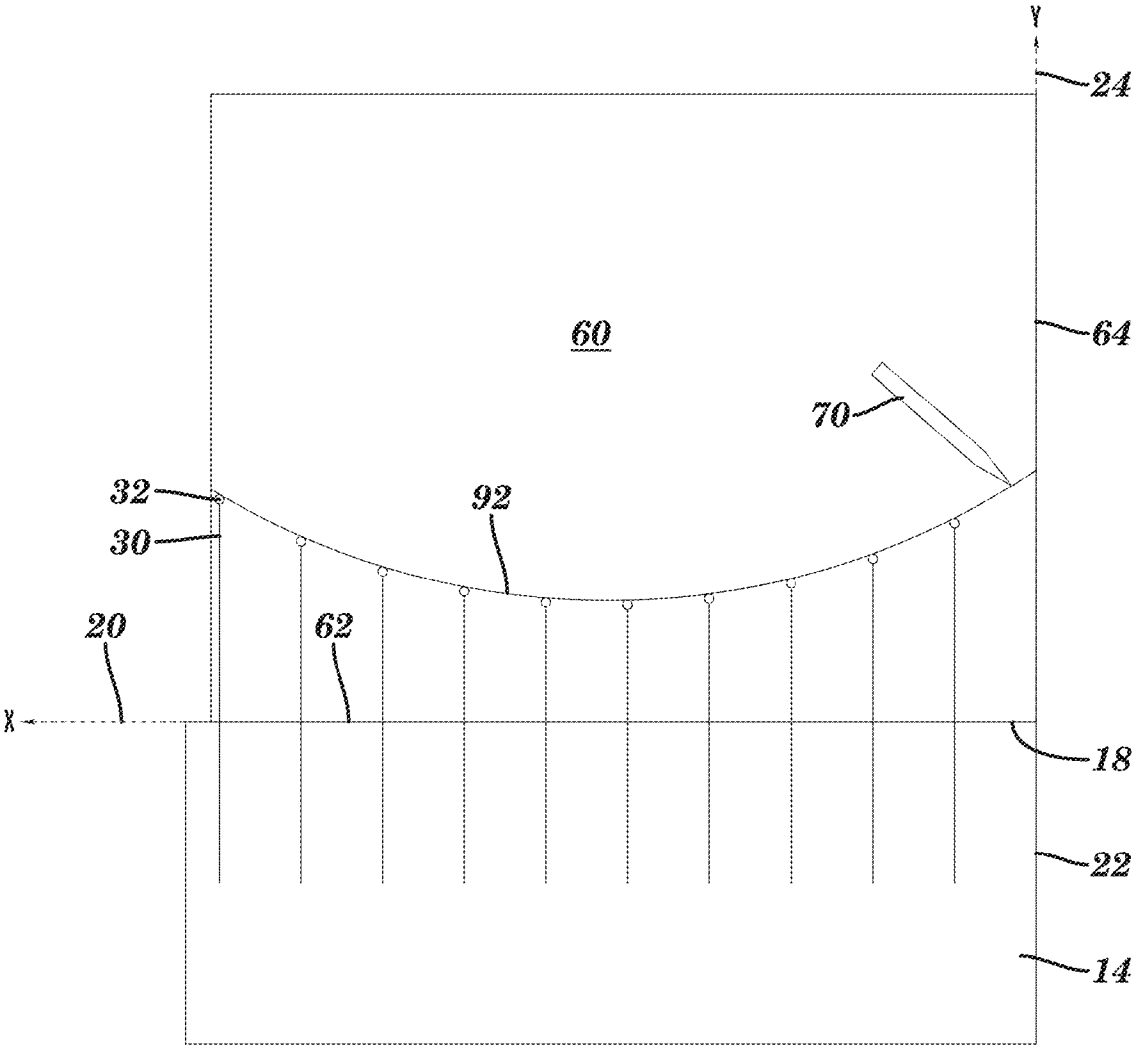
FIG. 9 is a schematic plan view of an alternate embodiment in an operative position.

In the embodiment of FIGS. 8 and 9, multiple fingers 30 may be extended to obstruction 58, as shown in FIG. 8. The distal ends of these fingers 30 trace the contour of obstruction 58. When the platform 14 is placed adjacent to loose tile 60, as shown in FIG. 9, the distal ends of extended fingers 30 delineate the profile of the obstruction 58. A notional profile line 92 may be traced on the surface of loose tile 60 with marking implement 70.

Figure 10:
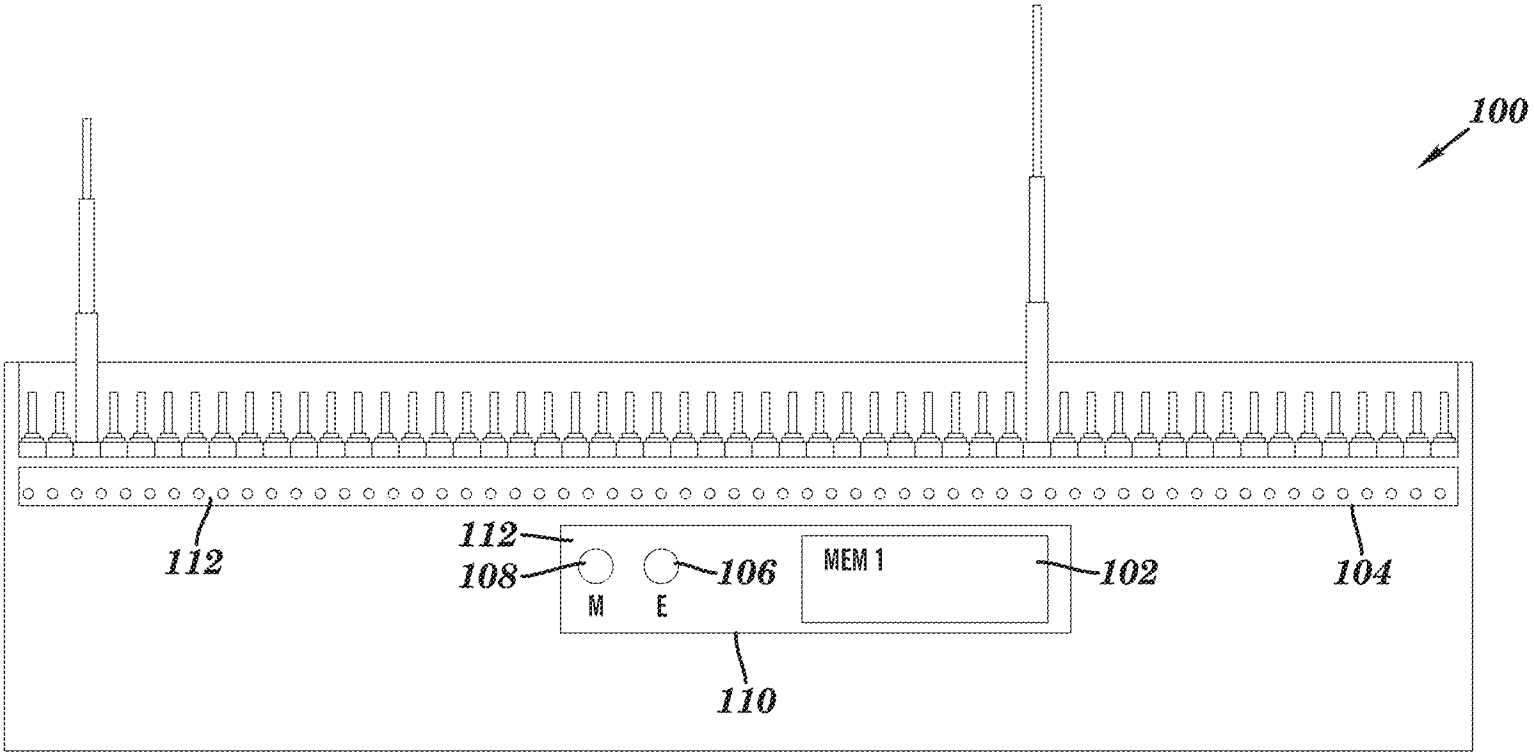
FIG. 10 is a plan view of an alternate embodiment in an operative position.

The embodiment of FIG. 10 includes a computing element 110 with a processor and a memory component. The computing element 110 is configured to store and retrieve configurations of x and y coordinates of the fingers. An optional user interface 112 may include a display screen 102. For example, the display 102 may indicate a particular configuration such as "MEM 1" which may be stored or retrieved from memory. Optional entry button 106 may be used to store configurations in memory, and optional retrieval button 108 may be used to retrieve configurations from memory. Optional coordinate display 104 may be used to display the coordinates of the fingers 30. For example, display 104 may be used to display the y coordinates for each finger, as shown. In this example, the y coordinates of fingers in contracted positions are calibrated at zero.

As further options, the fingers may be motorized, so that they may automatically return to set points stored in memory. In addition, the computing element 110 may be communicably coupled, e.g., by wire or wirelessly, to an automated computer controlled tile cutting machine, such as a cutting machine controlled in a manner similar to conventional CNC (Computer Numerical Control) milling machines.

Figure 11:
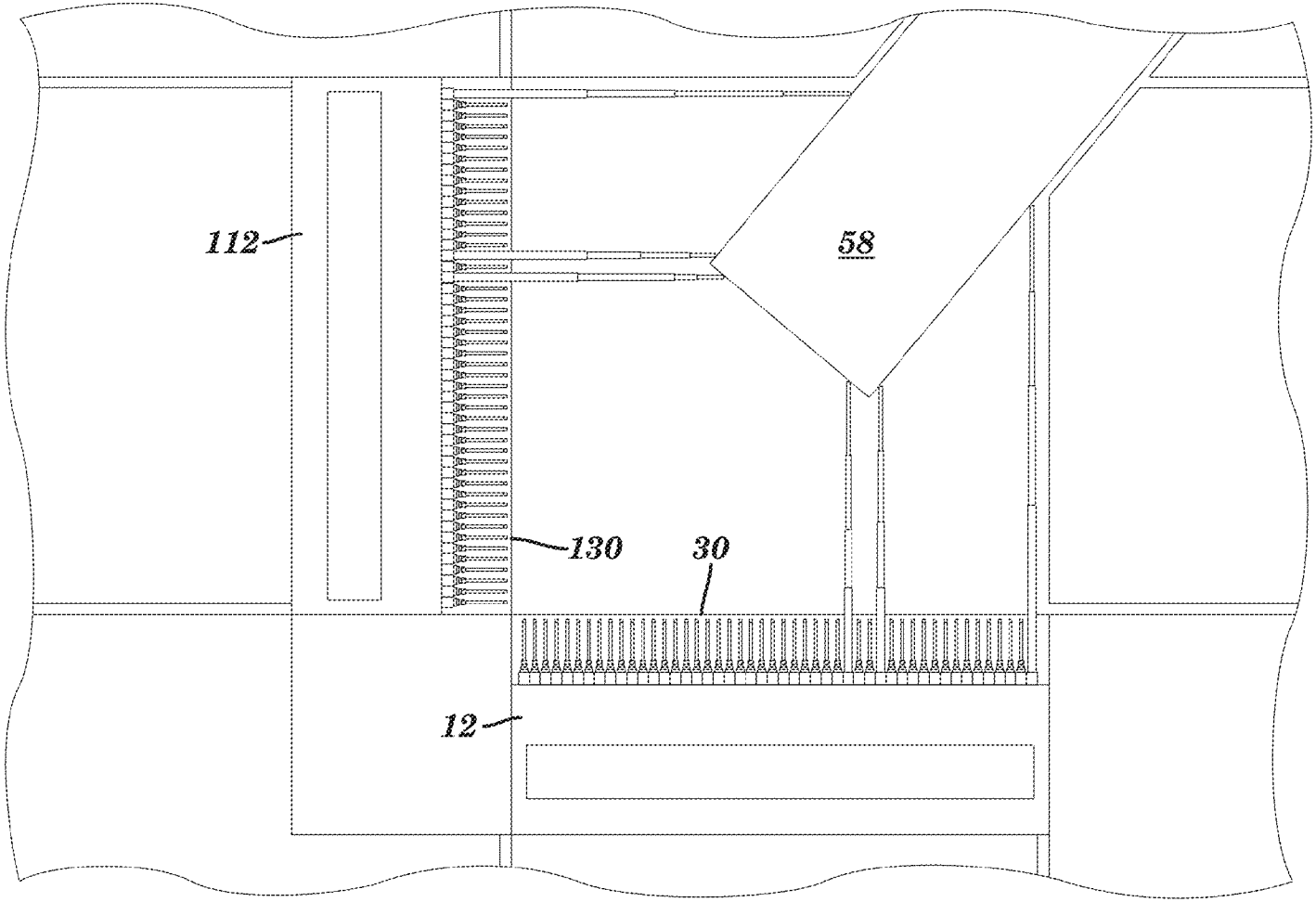
FIG. 11 is a plan view of an alternate embodiment in an operative position.
Figure 12:
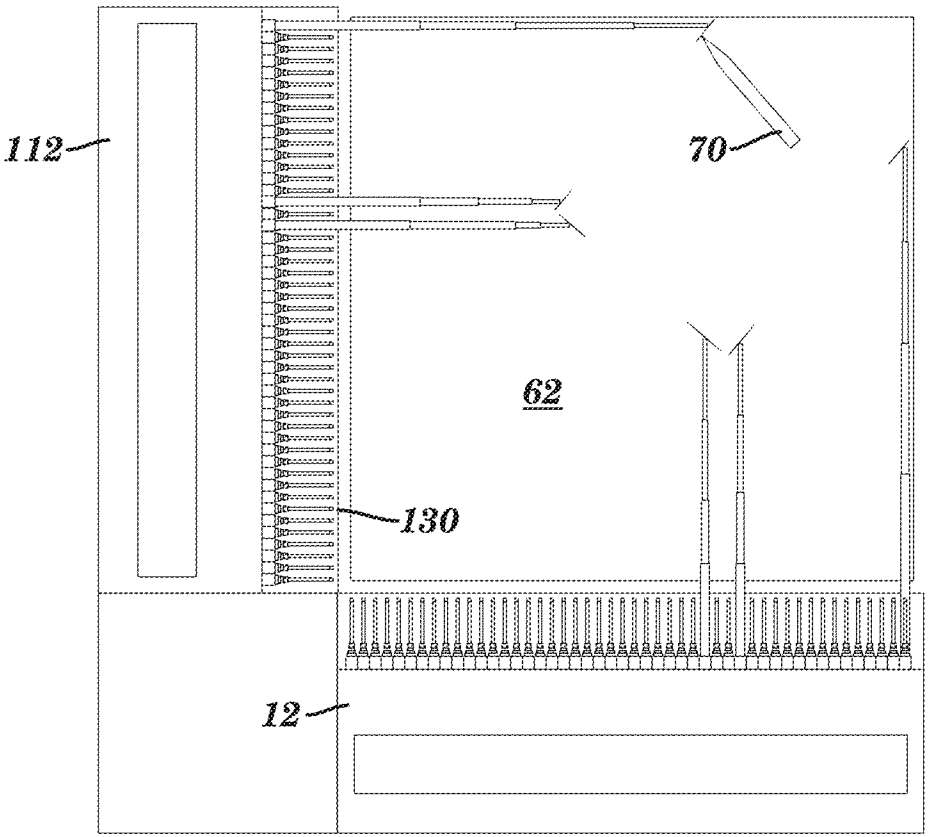
FIG. 12 is a plan view of an alternate embodiment in an operative position.
Figure 13:
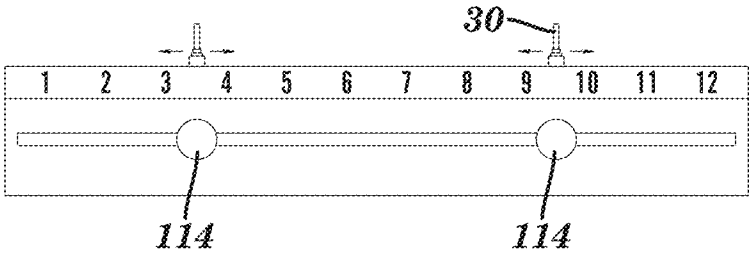
FIG. 13 is a plan view of an alternate embodiment.
Figure 14:
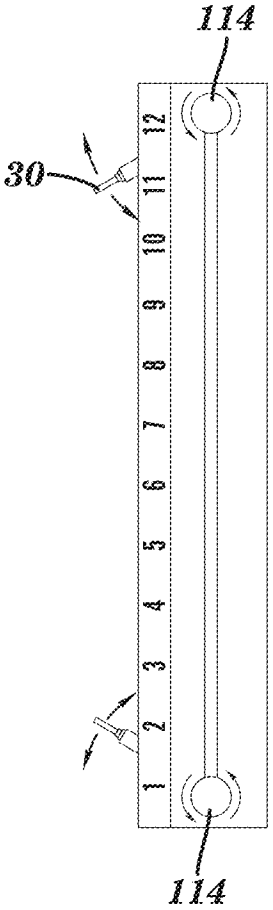
FIG. 14 is a plan view of an alternate embodiment.
Figure 15:
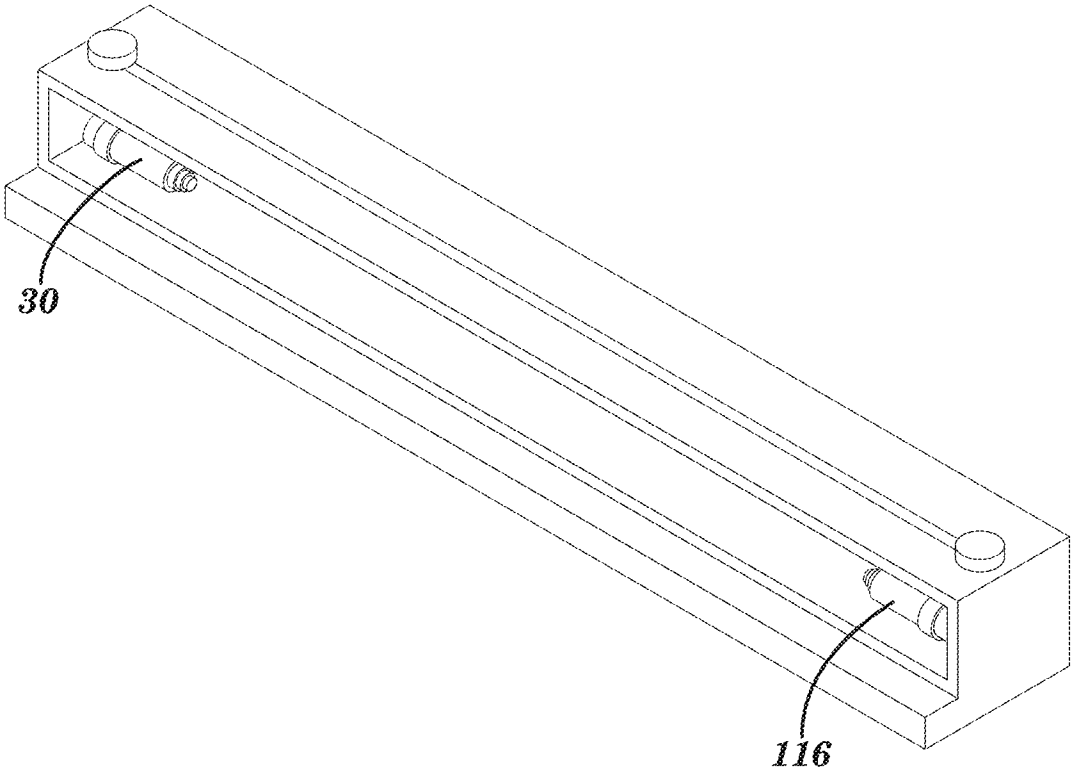
FIG. 15 is a perspective view of the embodiment of FIGS. 13 and 14.

As shown in relation to the embodiment of FIGS. 11 and 12, an additional body 112 may be disposed orthogonally to body 12, with fingers 130 extending in parallel with the X axis. This embodiment is particularly useful in measuring area with an obstruction with edges located at more than one y coordinate per x coordinate, such as obstruction 58.

Figure 17:
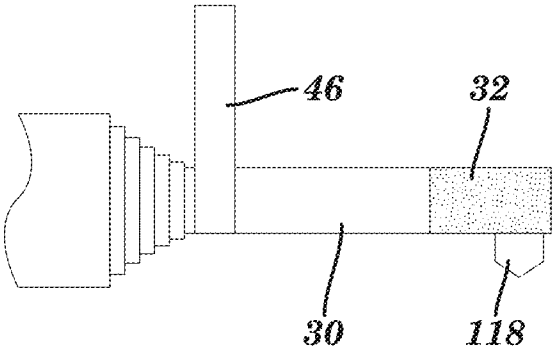
FIG. 17 is an elevational view of a portion of an alternate embodiment.
Figure 16:
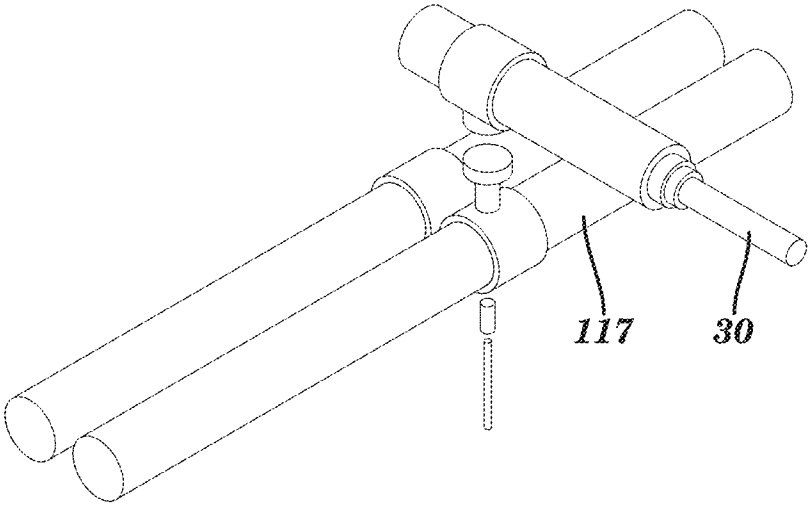
FIG. 16 is a perspective view of a portion of the embodiment of FIGS. 13 and 14.

As shown in the embodiment of FIGS. 13-16, dials 114 may be used to manually rotate fingers 32 to a retracted position 116, about a Z Axis which is orthogonal to both the X and Y Axes. This rotation may be used to effectively fold the tool to a relatively compact form factor when not in use, such as for convenient carrying within a user's pocket or tool box. The dials 114 may also be used to manually slide fingers 30 along track 117 in parallel with the X Axis to adjusted x coordinate positions. As shown in the embodiment of FIG. 17, the distal end 32 may include a marking implement 118 which may be used to mark the surface of the loose tile.

Figure 18B:
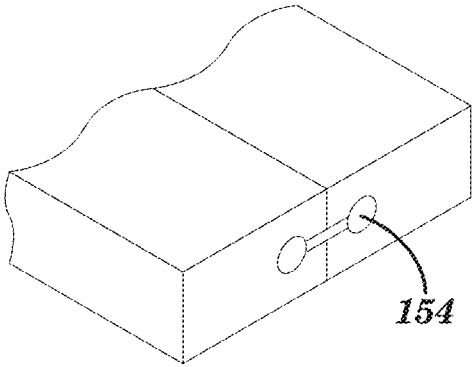
FIG. 18B is a perspective view of a portion of the embodiment of FIG. 18A.
Figure 18A:
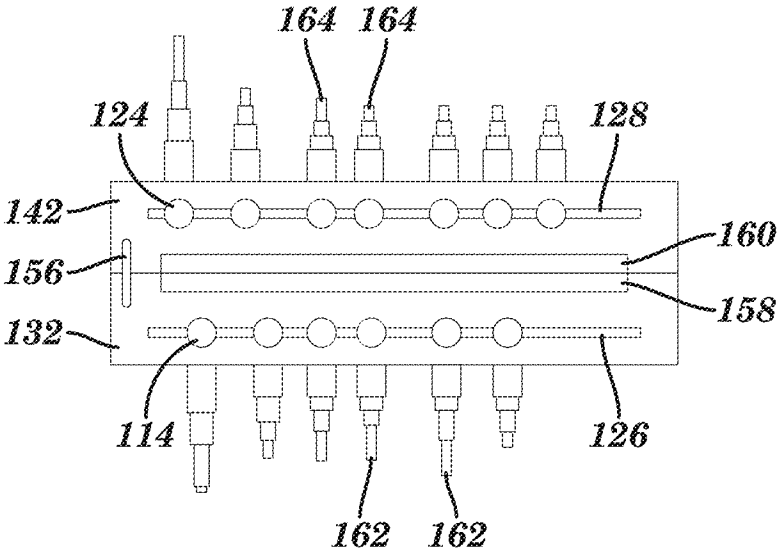
FIG. 18A is a plan view of an alternate embodiment.
Figure 18D:
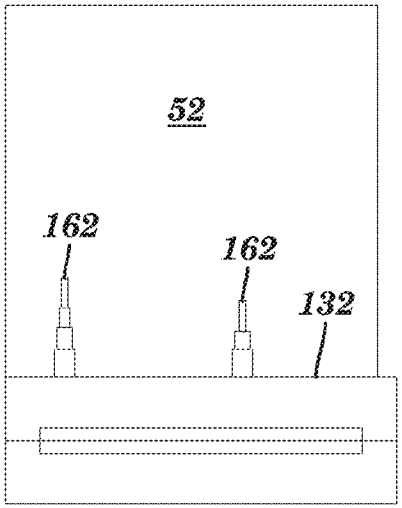
FIG. 18D is an elevational view of the embodiment of FIG. 18A.
Figure 18C:
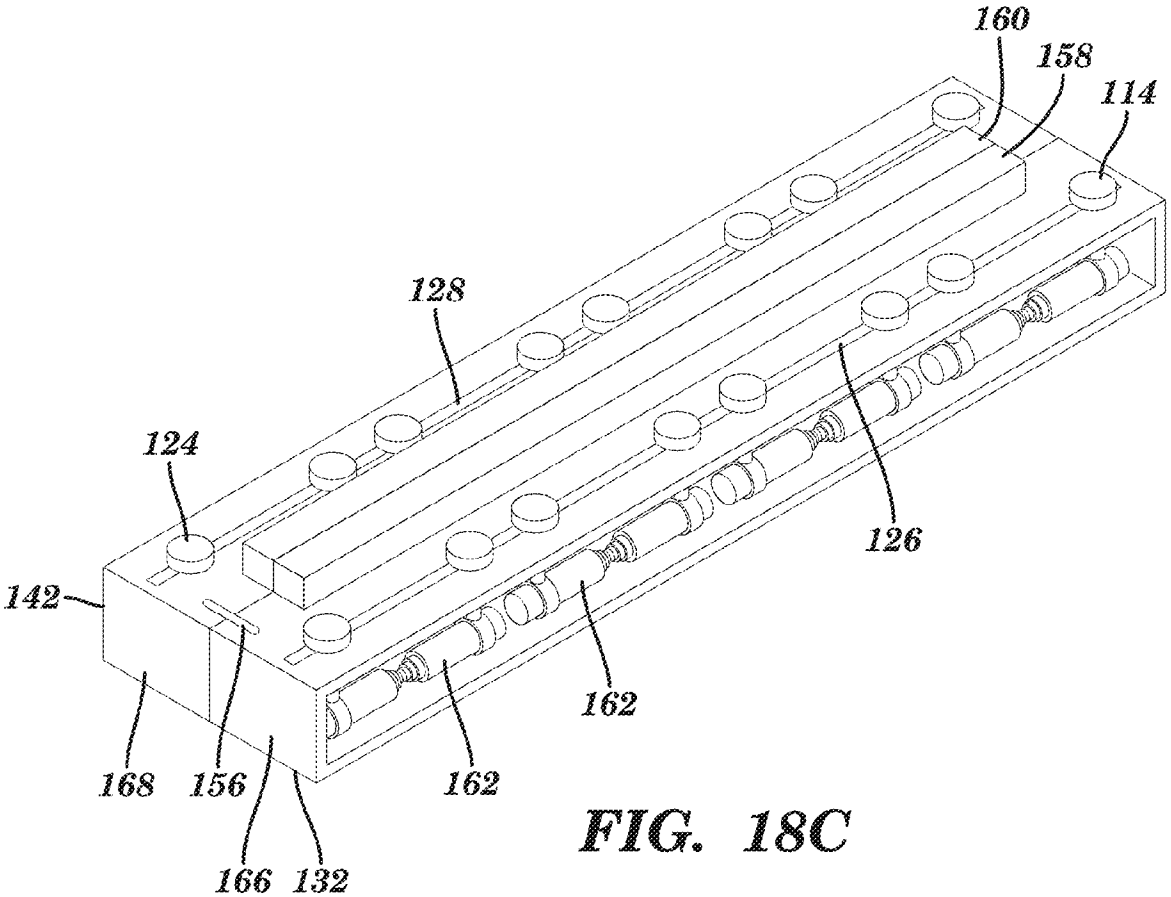
FIG. 18C is a perspective view of the embodiment of FIG. 18A.
Figure 18F:
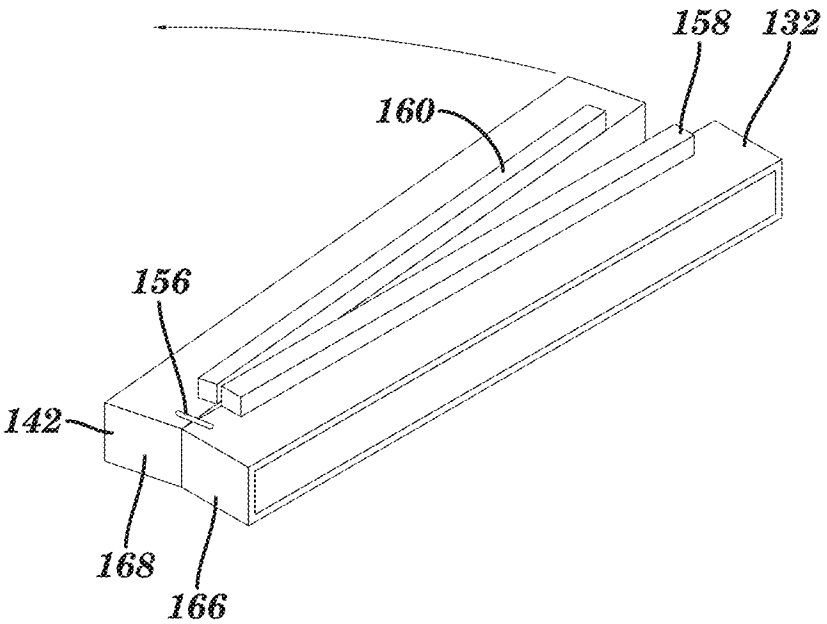
FIG. 18F is a perspective view of the embodiment of FIG. 18A.
Figure 18E:
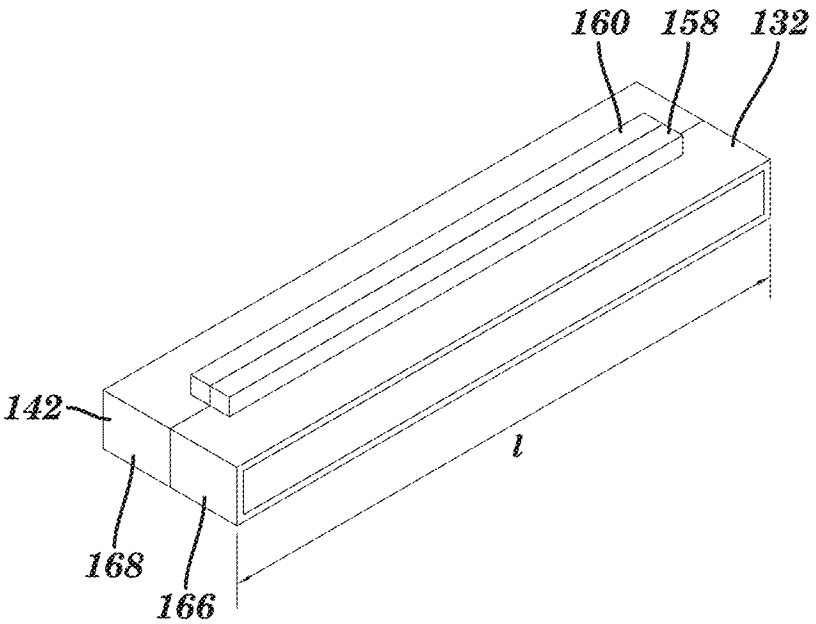
FIG. 18E is a perspective view of the embodiment of FIG. 18A.
Figure 18G:
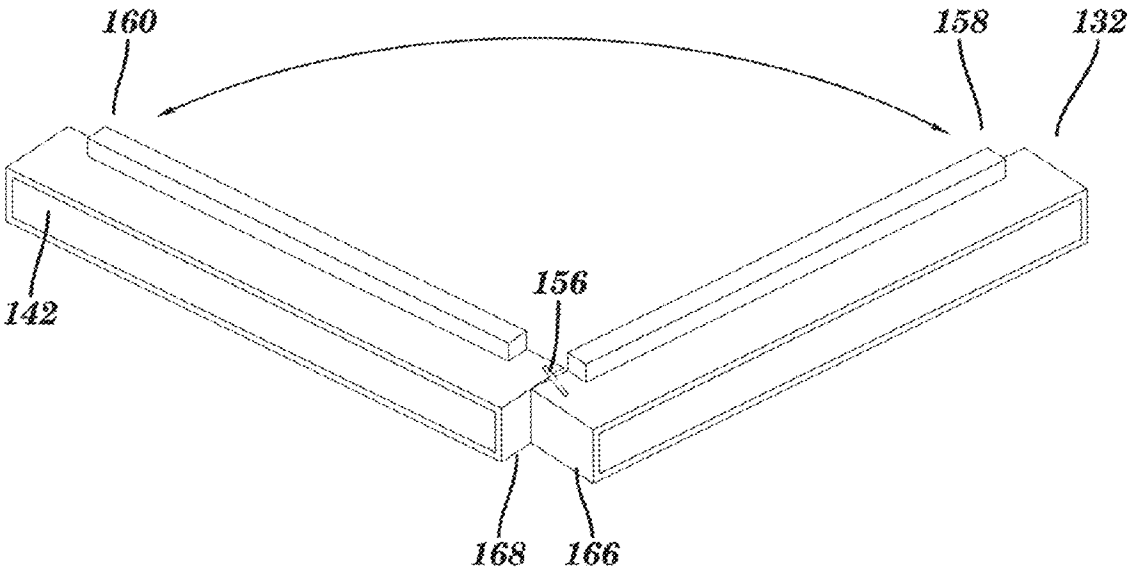
FIG. 18G is a perspective view of the embodiment of FIG. 18A.
Figure 18H:
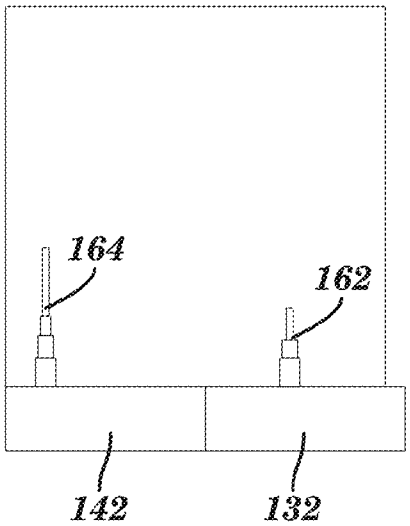
FIG. 18H is a perspective view of the embodiment of FIG. 18A.
Figure 18I:
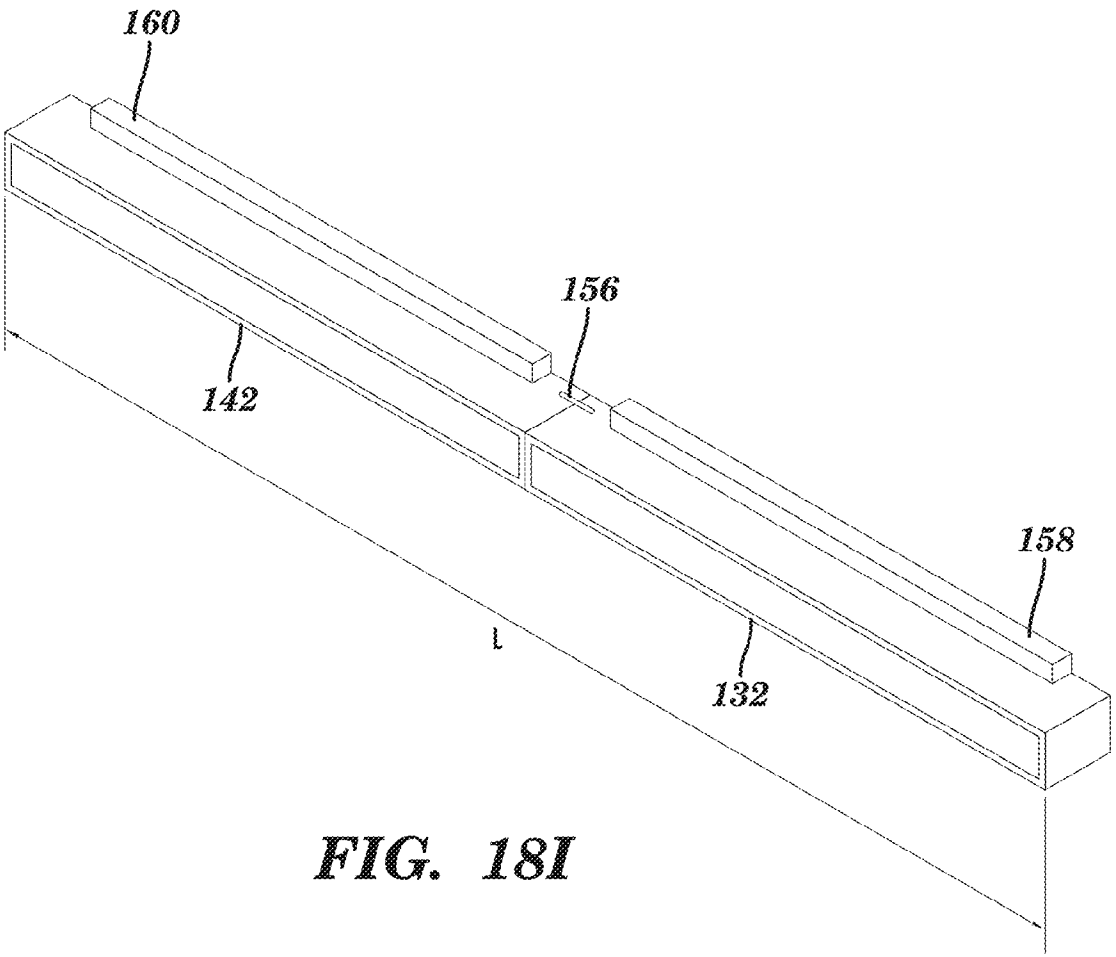
FIG. 18I is a perspective view of the embodiment of FIG. 18A.
Figure 18J:
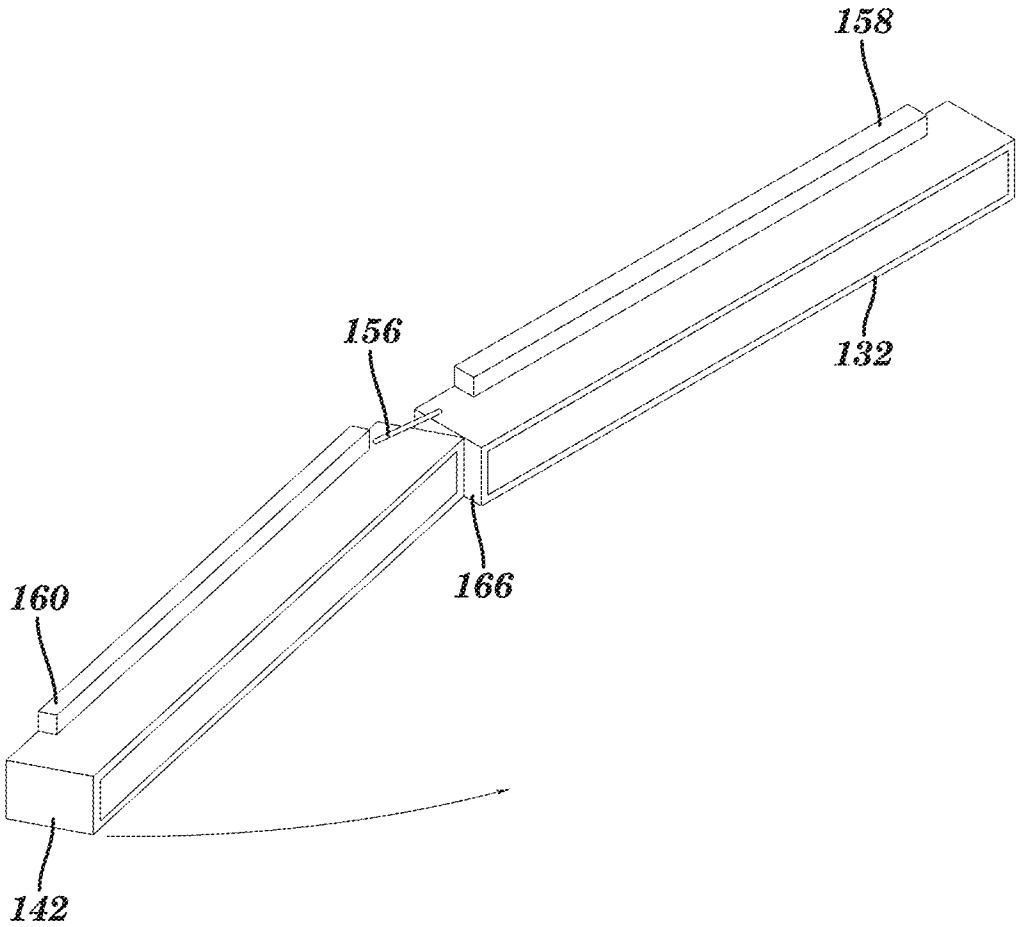
FIG. 18J is a perspective view of the embodiment of FIG. 18A.
Figure 18K:
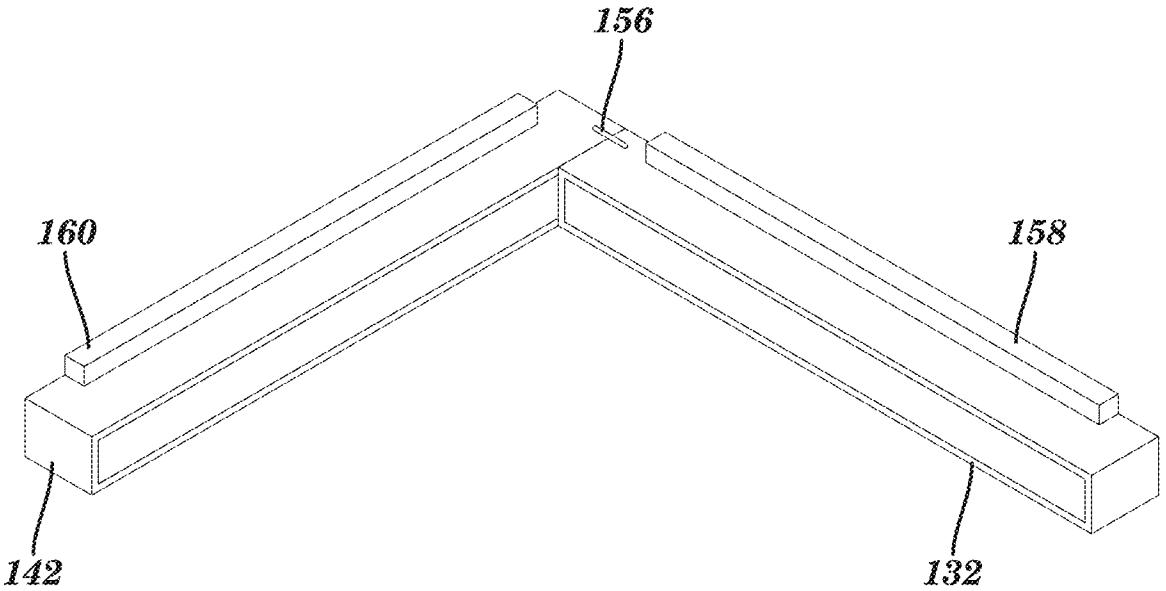
FIG. 18K is a perspective view of the embodiment of FIG. 18A.
Figure 18L:
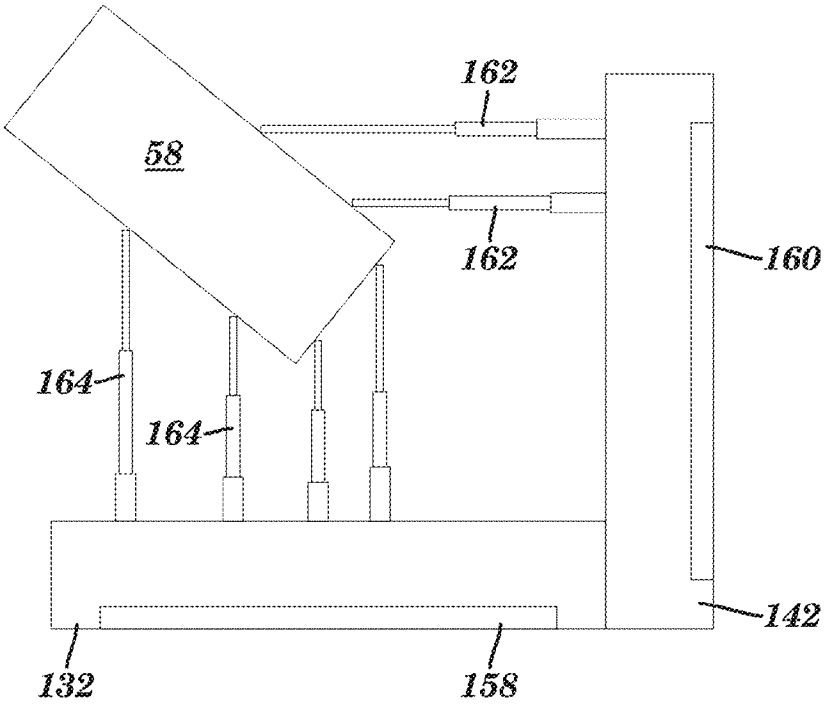
FIG. 18L is a plan view of the embodiment of FIG. 18A.

As shown in the embodiment of FIGS. 18A-18L, bodies 132 and 142 are connected by hinge 156, which allows the tool to be folded, expanded, and reshaped, according to the requirements of a particular job. The bodies 132 and 142 may be folded into a relatively compact closed position with a longitudinal dimension 1, as shown in FIG. 18E. The bodies 132 and 142 may be repositioned to an open position with a larger longitudinal dimension L, as shown in FIG. 18I. The bodies 132 and 142 may be repositioned to an L shape, as shown in FIG. 18L.

As mentioned above, the embodiment of FIGS. 18A-18L includes bodies 132 and 142, which are connected with a hinge 156. Fingers 162 are extendable from body 132, and fingers 164 are extendable from body 142. Handle 158 is disposed on body 132, and handle 160 is disposed on body 142. When this embodiment is in a closed position, handles 158 and 160 may optionally be aligned to function as a single handle. As shown in FIG. 18B, bodies 132, 142 may be held in a closed position with a clasp 154.

In the closed position, face 166 of body 132 is adjacent to face 168 of body 142. (FIG. 18E). Dials 124 may be used to rotate fingers 164 to retracted positions, and dials 114 may be used to rotate fingers 162 to retracted positions, as shown in FIG. 18C. Optionally, dials 114 may also be used to slide fingers 162 to releasably retained adjusted positions along track 126, and dials 124 may be used to slide fingers 164 to releasably retained positions along track 128, as shown in FIG. 18C.

This embodiment may be used in the closed position with a smaller tile, for example as shown in FIG. 18D. In this example, fingers 132 may be extended over a loose tile 52, such as square tile with a dimension of up to 12.0 inches (30.5 cm), as shown in the example of FIG. 18D.

The bodies 132, 142 may be adjusted to an open position when the clasp 154 is opened (FIG. 18B), as shown in FIGS. 18F-18I. Bodies 132 and 142 remain connected by hinge 156 as they are moved to the open position, as shown in FIGS. 18F, 18G. In the open position, face 166 and face 168 are engaged, and bodies 132 and 142 have a longitudinal dimension L, which is larger than l of the closed position. This tool may be used in the open position with a larger tile, for example a square tile with a dimension of up to 24.0 inches (61.0 cm), as shown in FIG. 18H.

As shown in FIGS. 18I-18J, bodies 132, 142 may be adjusted from an open position to an L-shaped position. Hinge 156 connects bodies 132 and 142 as body 142 is repositioned orthogonally to body 132. As shown in FIG. 18L, fingers 162 and 164 extend orthogonally to one another, similarly to fingers 30, 130 of the embodiment of FIGS. 11 and 12. As discussed above in reference to FIGS. 11 and 12, the L-shaped position may be particularly advantageous for use with an irregularly shaped obstruction 58.

Figure 19:
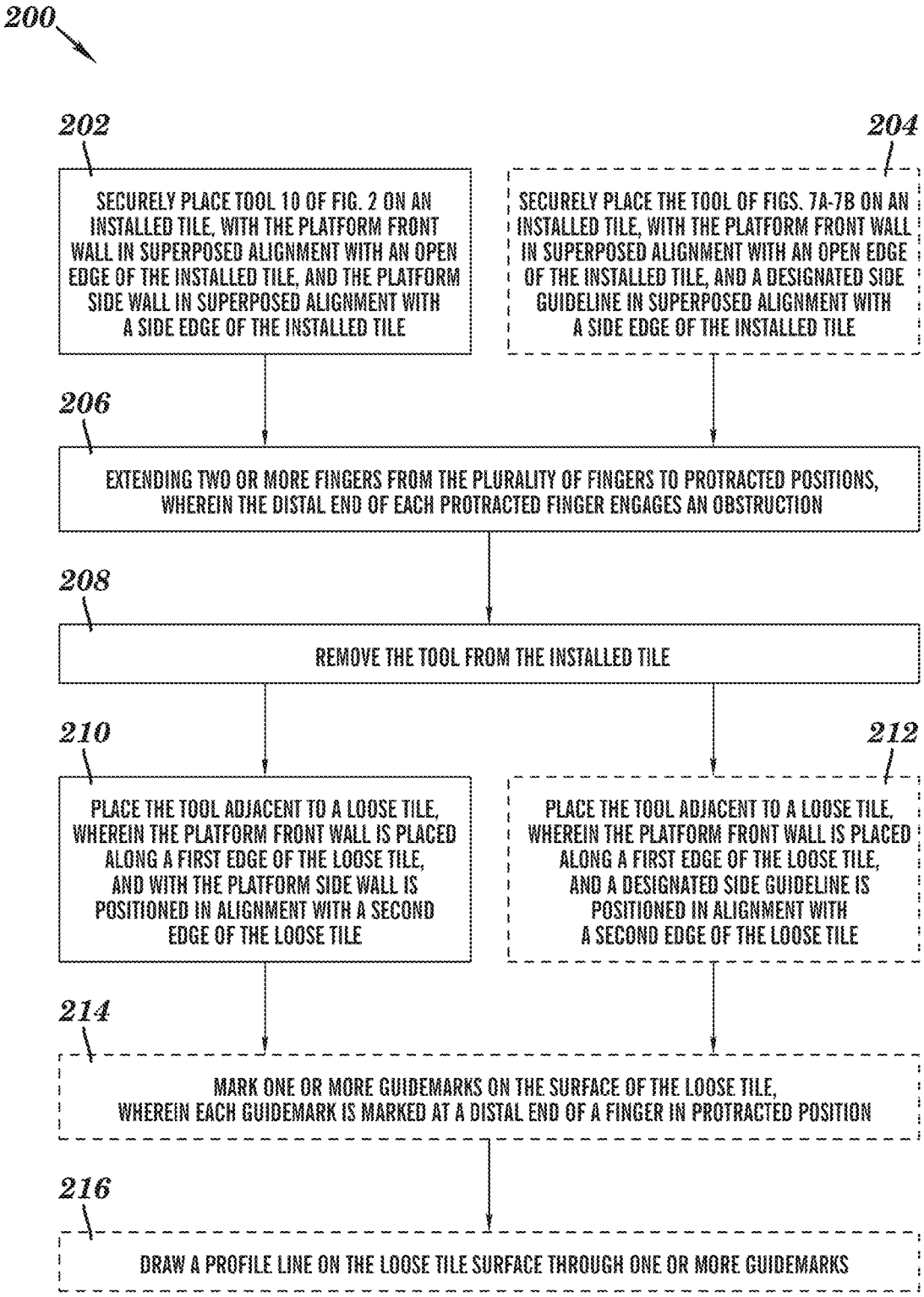
FIG. 19 is a flow chart of a method associated with an embodiment of the invention.

FIG. 19 illustrates a method of use 200 associated with an embodiment of the present invention. In step 202, the tool of FIGS. 1A, 2, and 3 is securely placed on an installed tile, with the platform front wall in superposed alignment with an open edge of the installed tile, and with the platform side wall in superposed alignment with a side edge of the installed tile. Alternatively, in optional Step 204, the tool of FIGS. 7A-7B is securely placed on an installed tile, with the platform front wall in superposed alignment with an open edge of the installed tile, and with a designated sideline in superposed alignment with a side edge of the installed tile.

The platform remains secured on the installed tile until it is removed in Step 208 below. For example, as mentioned above, an embodiment of the tool may comprise anchoring pads to securely anchor the platform to the installed tile.

In Step 206, two or more fingers are extended to protracted positions, wherein the distal end of each protracted finger engages an obstruction. In Step 208, the tool is removed from the installed tile.

In Step 210, the tool is placed adjacent to a loose tile, with the platform front wall placed along a first edge of the loose tile, and with the side wall positioned in alignment with a second edge of the loose tile. Alternatively, in optional step 212, the tool is placed adjacent to a loose tile, with the platform front wall placed along a first edge of the loose tile, and a designated side guideline positioned in alignment with a second edge of the loose tile.

The distal ends of the protracted fingers define dimensions for cutting the loose tile. In some embodiments, as discussed above, configurations of the x and y coordinates of each finger may be stored in memory with a computing element with a memory component. The user may optionally mark out the desired cutting dimensions on the surface of the loose tile. For example, in optional Step 214, one or more guidemarks is be marked on the surface of the loose tile. Each guidemark is marked at a distal end of a finger in protracted position. In optional Step 216, a profile line is drawn on the loose tile surface through one or more guidemarks.

Method 200 is an intuitive approach for making two dimensional measurements, without requiring a user to make mathematical calculations. This approach saves time because it results in an accurate two-dimensional measurement, without the trial and error of refining a template tile until it fits the area to be tiled.

Figure 20:
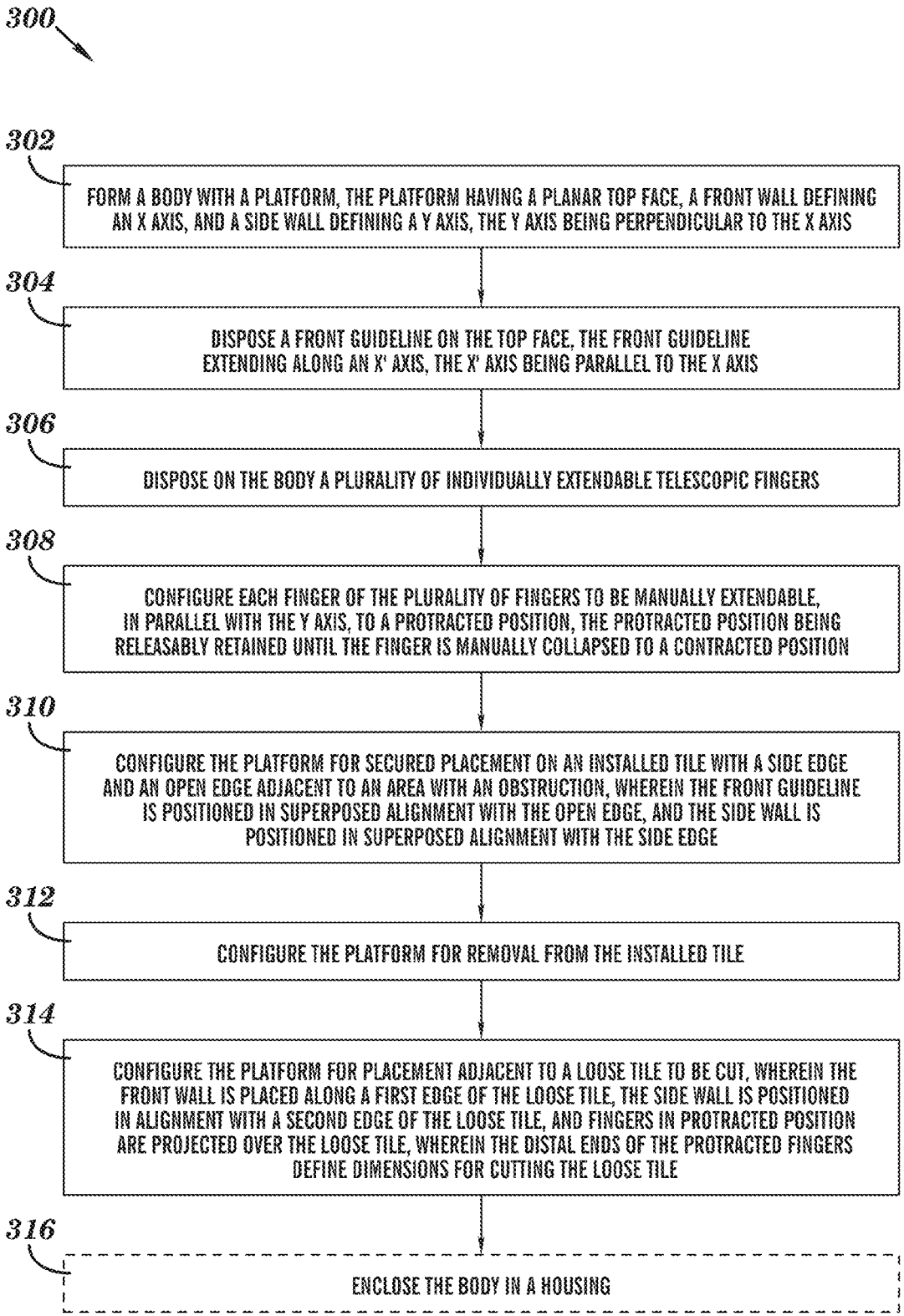
FIG. 20 is a flow chart of another method associated with an embodiment of the invention.

FIG. 20 illustrates a method 300 for manufacturing an embodiment of the present invention. In Step 302, a body is formed with a platform, the platform having a planar top face, a front wall defining an x axis, and a side wall defining a y axis, the y axis being perpendicular to the x axis. For example, forming the body may comprise extruding a polymeric material. In Step 304, a front guideline is disposed on the top face, the front guideline extending along an x' axis, the x' axis being parallel to the x axis.

In Step 306, a plurality of individually extendable telescopic fingers are disposed on the body. In Step 308, each finger of the plurality of fingers is configured to be manually extendable, in parallel with the y axis, to a protracted position. The protracted position may be releasably retained until the finger is manually collapsed to a contracted position. For example, telescoping antennae may be used as fingers.

In Step 310, the platform is configured for secured placement on an installed tile with a side edge and an open edge adjacent to an area with an obstruction, wherein the front guideline is positioned in superposed alignment with the open edge, and the side wall is positioned in superposed alignment with the side edge. In Step 312, the platform is configured for removal from the installed tile.

In Step 314, the platform is configured for placement adjacent to a loose tile to be cut, wherein the front wall is placed along a first edge of the loose tile, the platform side wall is positioned in alignment with a second edge of the loose tile, and fingers in protracted position are projected over the loose tile, wherein the distal ends of the protracted fingers define dimensions for cutting the loose tile. In optional Step 316, the body is enclosed in a housing.

Turning now to FIGS. 21-28, additional embodiments of the present invention are shown and described. As shown in FIG. 21A, tool 400 includes a body 12' with a plurality of extendable fingers 30 substantially as shown and described hereinabove. In addition, a flexible linked chain 410 is disposed at the distal end of each finger 30. In the particular examples shown, each chain 410 is disposed at approximately its midpoint, to its respective finger 30. As shown in FIG. 21B, the chain 410 may be fabricated from a plurality of links 412 each having a cylindrical pin which is press fit into a similarly sized and shaped bore (not shown) of an adjacent link. The press fit engagement of the links 412 is sufficient to make the chain 410 relatively stiff, while being conformable by a user's hands. The chains 410 may thus be moved into various positions by the user, e.g., to match the contour of an obstruction 58 (FIGS. 8, 23, 25), and then remain in those positions until again moved by the user, as will be discussed in greater detail hereinbelow. In particular aspects of the invention, the links 412 may be fabricated from a plastic (polymeric) material by any convenient manufacturing approach known to those skilled in the art, such as injection molding. A similar press fit arrangement may be used to secure the chain 410 to the distal end of the finger 30. In this regard, the center link of the chain 410 may be substantially "T" shaped, with an arm 414 extending substantially orthogonally from the chain, with a pin at its distal end which is configured for being received in a press fit manner by a receptacle disposed at the distal end of the finger 30.

Turning now to FIG. 22, in an alternate aspect of the invention, tool 400' is substantially similar to tool 400, though instead of telescoping fingers 30, uses extendable fingers 30' in the form of hinged links or segments 416. Segments 416 are hinged to one another using press fit hinge pins, e.g., as described with respect to links 412, to permit fingers 30' to be selectively expanded and contracted in an accordion style movement into various positions as shown. The friction of the press fit pins serves to maintain the fingers 30' in those positions until again manipulated by the user.

Figure 23:
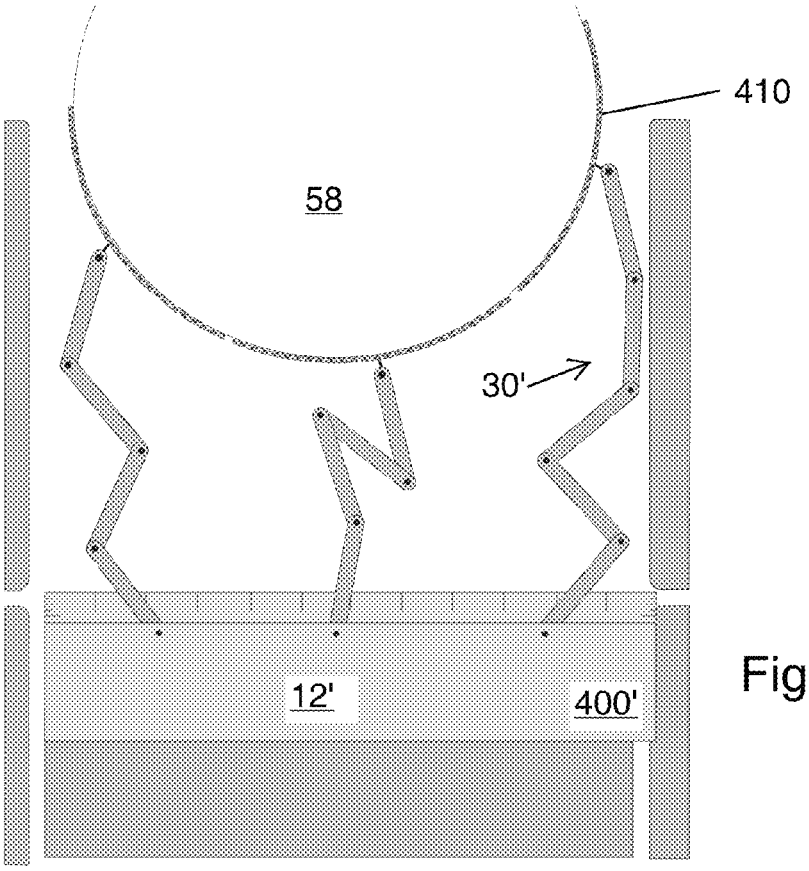
FIG. 23 is a plan view of the embodiment of FIG. 22 during operation.
Figure 24:
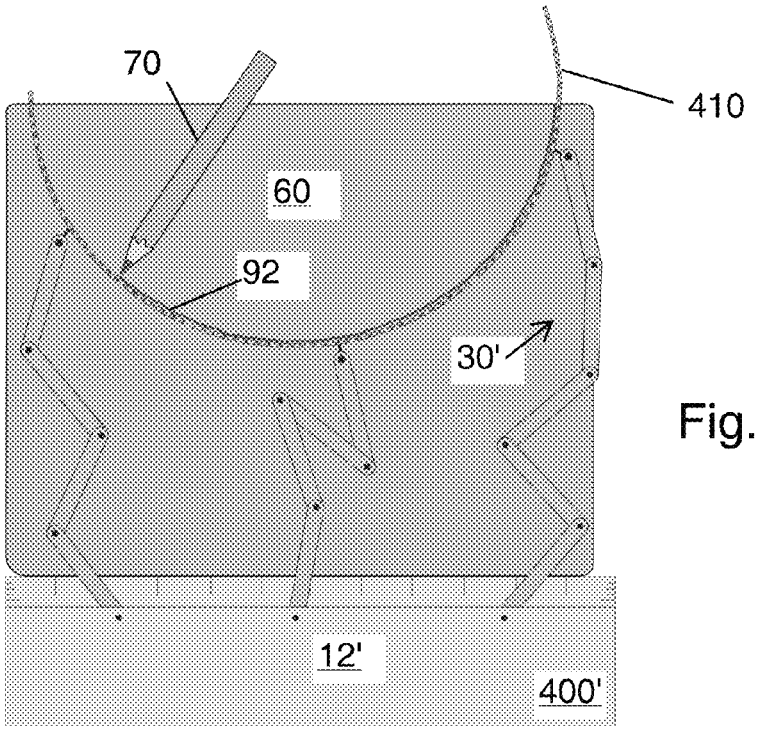
FIG. 24 is a plan view of the embodiment of FIG. 22 during operation.
Figure 25:
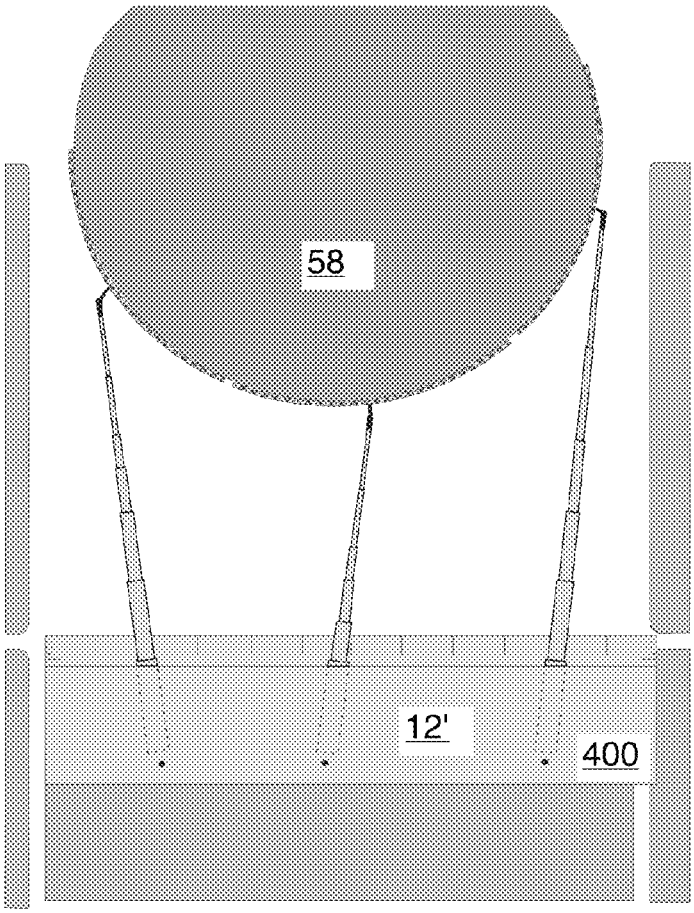
FIG. 25 is a plan view of the embodiment of FIG. 21A during operation.
Figure 26:
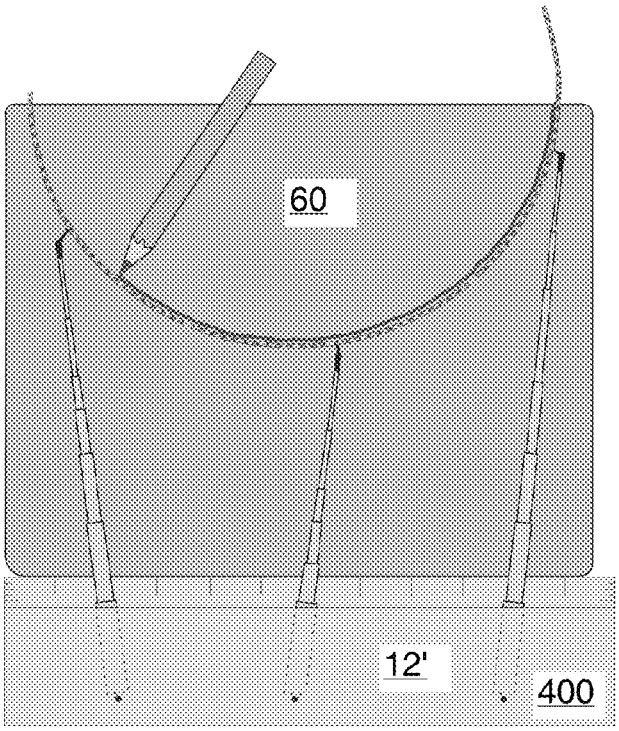
FIG. 26 is a plan view of the embodiment of FIG. 21A during operation.

As shown in FIG. 23, when operating tool 400', the fingers 30' may be extended to obstruction 58. The chains 410 at the distal ends of these fingers 30 may then be extended along the perimeter (profile) of obstruction 58 to effectively match the contour thereof. Tool 410' may then be removed from the obstruction 58, with the fingers 30' and chains 410 maintaining their orientation relative to body 12'. The body 12' of tool 400' is then placed adjacent to a loose tile 60, as shown in FIG. 24, so that the chains 410 will delineate the profile of the obstruction 58. A profile line 92 may be traced on the surface of loose tile 60 with marking implement 70. A similar approach may be used with tool 400, such as shown in FIGS. 25 and 26.

Figure 27:
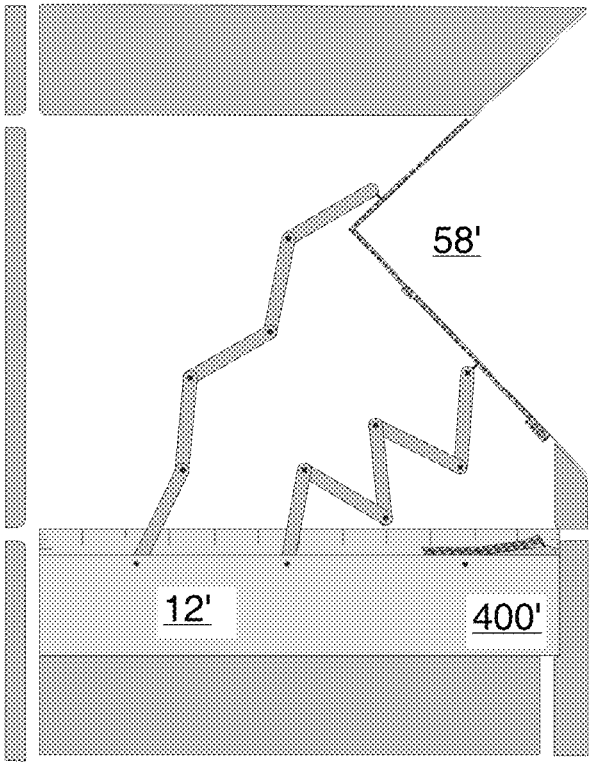
FIG. 27 is a plan view of the embodiment of FIG. 22 during operation.
Figure 28:
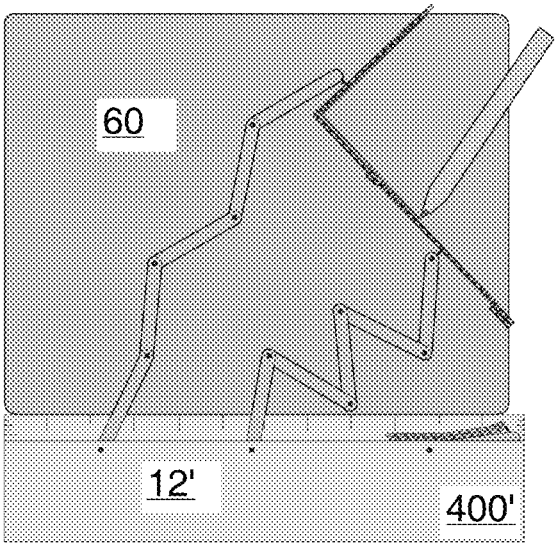
FIG. 28 is a plan view of the embodiment of FIG. 22 during operation.

Tools 400 and 400' may also be used to conveniently capture the contour of relatively complex profiles, such as that shown in FIGS. 11 and 12, but without the need for a second body 112. For example, as shown in FIG. 27, the chains 410 may effectively reach around a corner of the obstruction 58' to capture its profile, which may then be traced onto a loose tile 60 as shown in FIG. 28. In this manner, the chains 410 of tools 400 and 400' are configured to delineate profiles extending through points having the same x-axis coordinate, but different y-axis coordinates, without the need for a second body 112 (FIG. 11).

Figure 29:
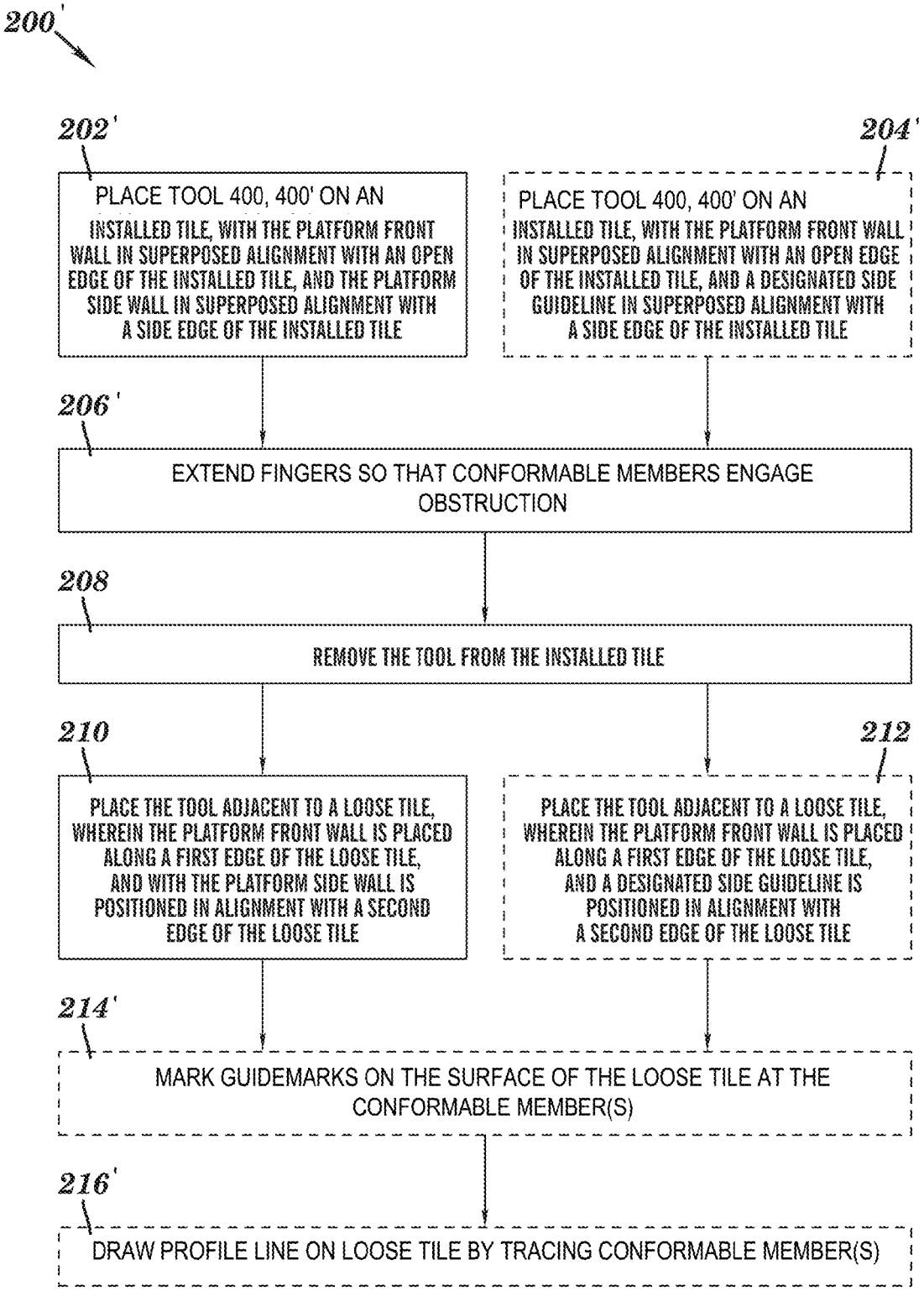
FIG. 29 is a flow chart of a method associated with an embodiment of the invention.

FIG. 29 illustrates a method of use 200' associated with tools 400, 400' of the present invention. In step 202', the tool 400, 400' is securely placed on an installed tile, with the platform front wall in superposed alignment with an open edge of the installed tile, and with the platform side wall in superposed alignment with a side edge of the installed tile. Alternatively, in optional Step 204', the tool is securely placed on an installed tile, with the platform front wall in superposed alignment with an open edge of the installed tile, and with a designated sideline in superposed alignment with a side edge of the installed tile.

The platform remains secured on the installed tile until it is removed in Step 208 below. For example, as mentioned above, an embodiment of the tool may comprise anchoring pads to securely anchor the platform to the installed tile.

At 206', two or more fingers are extended to protracted positions, wherein the conformable member (e.g., chain) 410 at the distal end of each finger engages an obstruction. In Step 208, the tool is removed from the installed tile.

At 210, the tool is placed adjacent to a loose tile, with the platform front wall placed along a first edge of the loose tile, and with the side wall positioned in alignment with a second edge of the loose tile. Alternatively, in optional step 212, the tool is placed adjacent to a loose tile, with the platform front wall placed along a first edge of the loose tile, and a designated side guideline positioned in alignment with a second edge of the loose tile.

The conformable members 410 at the distal ends of the protracted fingers define dimensions for cutting the loose tile. In some embodiments, as discussed above, configurations of the x and y coordinates of each finger may be stored in memory with a computing element with a memory component. The user may optionally mark out the desired cutting dimensions on the surface of the loose tile. For example, in optional Step 214', one or more guidemarks is be marked on the surface of the loose tile at a conformable member. Each guidemark is marked at a point along the conformable member 410. In optional Step 216', a profile line is drawn on the loose tile surface by tracing along the length of the conformable member.

Method 200' is an intuitive approach for making two dimensional measurements, without requiring a user to make mathematical calculations. This approach saves time because it results in an accurate two-dimensional measurement, without the trial and error of refining a template tile until it fits the area to be tiled. It should be understood that any of the features described with respect to one of the embodiments described herein may be used with any other of the embodiments described herein without departing from the spirit and scope of the present invention.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

Having thus described the invention, what is claimed is:

1. A tool for determining dimensions for cutting a tile, comprising:

a body including a platform with a planar top face, a front wall defining an x axis and an x-direction, and a side wall defining a y axis defining a y-direction, the y axis being perpendicular to the x axis;

a front guideline disposed on the top face, the front guideline extending along an x' axis, the x' axis being parallel to the x axis;

a plurality of individually extendable fingers coupled to said body, each finger of said plurality being manually extendable, in the y-direction, to a protracted position, the protracted position being releasably retained until the finger is manually collapsed to a contracted position;

a conformable member disposed at the distal end of each finger, the conformable member being conformable independently of the extendibility of the finger and configured to maintain its shape after being manipulated by a user;

said platform being configured for placement on an installed tile with a side edge and an open edge adjacent to an area with an obstruction, wherein the front guideline is positioned in superposed alignment with the open edge, and the side wall is positioned in superposed alignment with the side edge;

wherein a selection of fingers, including at least two of said plurality of fingers, are extendable towards their protracted positions until the conformable member at the distal end of each finger is engaged with and conformably moved to match the contour of the obstruction;

said platform being further configured for removal from the installed tile and for placement adjacent to a loose tile to be cut, wherein the front wall is placed along a first edge of the loose tile, the side wall is positioned in alignment with a second edge of the loose tile, and the fingers and conformable members of the selection are projected over the loose tile;

wherein the conformable members of the selection define dimensions for cutting the loose tile.

2. The tool of claim 1, wherein the conformable member comprises a flexible linked chain.

3. The tool of claim 2, wherein each flexible linked chain is disposed, at a mid-portion thereof, to the distal end of each finger.

4. The tool of claim 2, wherein the flexible linked chain comprises a plurality of links fastened to one another with press fit hinge pins, wherein adjacent links are configured to maintain their orientation relative to one another after manipulation by the user.

5. The tool of claim 4, wherein the links are fabricated from a plastic material.

6. The tool of claim 1, wherein the extendable fingers comprise telescoping fingers.

7. The tool of claim 1, wherein the extendable fingers comprise hinged segments configured for accordion-style movement between the protracted and contracted positions, the segments fastened to one another with press fit hinge pins, wherein adjacent segments are configured to maintain their orientation relative to one another after manipulation by the user.

8. The tool of claim 1, wherein the conformable members delineate a profile for marking the surface of the loose tile to demarcate dimensions for cutting the loose tile.

9. The tool of claim 8, wherein the conformable members are configured to delineate profiles extending through points having the same x-axis coordinate, and different y-axis coordinates.

10. The tool of claim 1, wherein each of said plurality of fingers in contracted position is configured for rotation about a z axis to a retracted position, wherein the z axis is orthogonal to the x axis and the y axis.

11. The tool of claim 1, further comprising a manually movable marking instrument disposed proximate the distal end of a finger of the plurality of fingers, the marking instrument configured for manual marking of the loose tile surface.

12. The tool of claim 1, said selection of fingers comprising first and second fingers, the distal end of said first finger being disposed at a x coordinate x1, and y coordinate y1, the distal end of said second finger being disposed at x coordinate x2 and y coordinate y2, wherein the coordinates (x1, y1) and (x2,y2) define a notional profile along which the loose tile is to be cut.

13. The tool of claim 1, said body further comprising a computing element with a processor and a memory component.

14. The tool of claim 13, wherein said computing element is configured to store and retrieve data relating to configurations of said plurality of fingers, wherein each configuration includes the x coordinate and the y coordinate of each finger in said plurality.

15. The tool of claim 13, said body further comprising a user interface configured for user control of the computing element.

16. The tool of claim 13, wherein said computing element is configured to transmit data stored in memory to an automated computer controlled cutting machine.

17. The tool of claim 13, wherein said memory component is physically removable from said tool.

18. The tool of claim 14, further comprising actuators, said actuators configured to mechanically adjust each finger of said plurality to the corresponding x and y coordinates of a configuration retrieved from memory.

19. A method for determining dimensions for cutting a tile, comprising:

(a) securely positioning the tool of claim 1 on the installed tile, wherein the front wall is placed in superposed alignment with the installed tile open edge, and the side wall is placed in superposed alignment with the installed tile side edge;

(b) extending two or more fingers from said plurality of fingers to protracted positions, wherein the conformable member at the distal end of each protracted finger engages the obstruction;

(c) removing the tool from the installed tile; and (d) placing the tool adjacent to a loose tile, wherein the front wall is placed along a first edge of the loose tile, and the side wall is positioned in alignment with a second edge of the loose tile.

20. The method of claim 19, further comprising (e) marking at least one marking point or profile line on the surface of the loose tile, along the conformable member at a distal end of a finger in protracted position.

* * * * *